US008821304B2

(12) United States Patent
Ensing

(10) Patent No.: US 8,821,304 B2
(45) Date of Patent: Sep. 2, 2014

(54) WATER ERUPTION EFFECT AND INTERACTIVE WATER PLAY STRUCTURE

(75) Inventor: Harley Ensing, North Vancouver (CA)

(73) Assignee: Whitewater West Industries Ltd. (CA)

( * ) Notice: Subject to any disclaimer, the term of this patent is extended or adjusted under 35 U.S.C. 154(b) by 314 days.

(21) Appl. No.: 13/193,480

(22) Filed: Jul. 28, 2011

(65) Prior Publication Data

US 2012/0028724 A1 Feb. 2, 2012

Related U.S. Application Data

(60) Provisional application No. 61/368,567, filed on Jul. 28, 2010.

(51) Int. Cl.
*A63G 31/00* (2006.01)
*A63G 21/18* (2006.01)

(52) U.S. Cl.
USPC ..... 472/128

(58) Field of Classification Search
USPC ..... 472/13, 117, 128, 129; 446/85, 86
See application file for complete search history.

(56) References Cited

U.S. PATENT DOCUMENTS

| | | | | |
|---|---|---|---|---|
| 5,194,048 | A | 3/1993 | Briggs | |
| 5,378,197 | A | 1/1995 | Briggs | |
| 5,405,294 | A | 4/1995 | Briggs | |
| 5,480,336 | A * | 1/1996 | Blanchard | 446/89 |
| 5,662,525 | A | 9/1997 | Briggs | |
| D406,871 | S | 3/1999 | Briggs | |
| D407,133 | S | 3/1999 | Briggs | |
| D413,957 | S | 9/1999 | Briggs | |
| 5,967,901 | A | 10/1999 | Briggs | |
| 6,186,902 | B1 | 2/2001 | Briggs | |
| 6,210,287 | B1 | 4/2001 | Briggs | |
| 6,319,139 | B1 * | 11/2001 | Tracy | 472/128 |
| 6,375,578 | B1 | 4/2002 | Briggs | |
| 6,443,849 | B1 * | 9/2002 | Byrd | 472/116 |
| 6,569,023 | B1 | 5/2003 | Briggs | |
| 6,739,979 | B2 * | 5/2004 | Tracy | 472/128 |
| 6,786,830 | B2 | 9/2004 | Briggs et al. | |
| 7,178,534 | B2 * | 2/2007 | Garman et al. | 134/167 C |
| 7,431,654 | B2 * | 10/2008 | Ochi | 472/117 |
| 8,012,031 | B2 * | 9/2011 | Stuart et al. | 472/117 |

OTHER PUBLICATIONS

Crystal Fountains, schematic, available Jul. 27, 2010.
Crystal Fountains, column pod photograph, available Jul. 14, 2010.
Crystal Fountains, schematic, available Jul. 14, 2010.
Photograph of public fountain, available prior to Jul. 28, 2010.

* cited by examiner

*Primary Examiner* — Kien Nguyen
(74) *Attorney, Agent, or Firm* — Greenberg Traurig

(57) ABSTRACT

A participatory water play structure including a water eruption effect device. The water eruption effect device may include a water eruption jet, lighting devices, sound devices, light towers, mist or smoke devices and fountain devices. The water eruption effect device imitates a geyser, volcanic eruption, or large water spray, dousing play participants in a participatory play structure with a cool deluge of water. The water eruption effect may also be used as a show feature during night-time operation of the participatory play structure. Responsive water play devices may also be used, including RFID and motion sensor systems that respond to the presence of play participants and to identifying characteristics of the play participants.

20 Claims, 18 Drawing Sheets

WATER ERUPTION EFFECT AND INTERACTIVE WATER PLAY STRUCTURE

RELATED APPLICATIONS

This application claims the benefit and priority of U.S. Provisional Patent Application No. 61/368,567, filed on Jul. 28, 2010, the entire disclosure of which is hereby incorporated by reference herein.

FIELD

The present invention relates to water play devices, and, in particular, to a water eruption effect for a participatory water play system and interactive water play devices for entertaining play participants.

BACKGROUND

The popularity of family-oriented water theme parks and recreational water facilities has increased dramatically in the last decade. Water parks have proliferated as adults and children, alike, seek the thrill and entertainment of water parks as a healthy and enjoyable way to cool off in the hot summer months.

Most water theme parks, like their dry counterparts, consist primarily of ride attractions. The most popular among these are water slides in which participants slide down a wet trough or tunnel and splash down into a pool of water. As demand for such water attractions has increased, water parks have continued to evolve ever larger and more complex water slides to thrill and entertain growing numbers of water play participants. Other popular ride attractions include surfing wave simulators, log flumes and white-water rafting.

While these water ride attractions are very popular, particularly among older children and adults, a common complaint is that participants often must spend more time waiting in lines for the various rides than actually riding on them. Also, many of the most popular water rides are unsuited for small children because of the inherent dangers of drowning or possible uncontrolled collision with other ride participants.

As a result, families with small children often have to split their time between either participating in the more popular rides or looking after the small children. While most water parks have recreational facilities for entertaining small children, they are generally limited to small wading pools, miniature water slides, and static play structures. While these may be moderately entertaining for small children, they fail to entertain parents or provide the creative stimulation and interactive educational experience that captivates the imaginations of small and intermediate-age children.

SUMMARY

Generally described herein is a water eruption effect device and a method for producing the water eruption effect. The water eruption effect device may comprise a series of components, including a water eruption jet, lighting devices, sound devices, light towers, mist or smoke devices and fountain devices. The water eruption effect device imitates a geyser, volcanic eruption, or large water spray, dousing play participants in a participatory play structure with a cool deluge of water. The water eruption effect may also be used as a show feature during night-time operation of the water play structure. The method for producing the water eruption effect may include, but is not limited to, steps for providing and operating the water eruption effect.

Also described herein is a light tower device that may operate independently from the water eruption effect device. The light tower device comprises a columnar structure that emits light from the interior of the device, and has a sheet of water travelling down the outer surface of the device.

Also described herein are effect features that may be used to perform a night-time show for the participatory play structure.

Also described herein are responsive water play devices, including RFID and motion sensor systems that respond to the presence of play participants and to identifying characteristics of the play participants.

DETAILED DESCRIPTION

Figure 1:
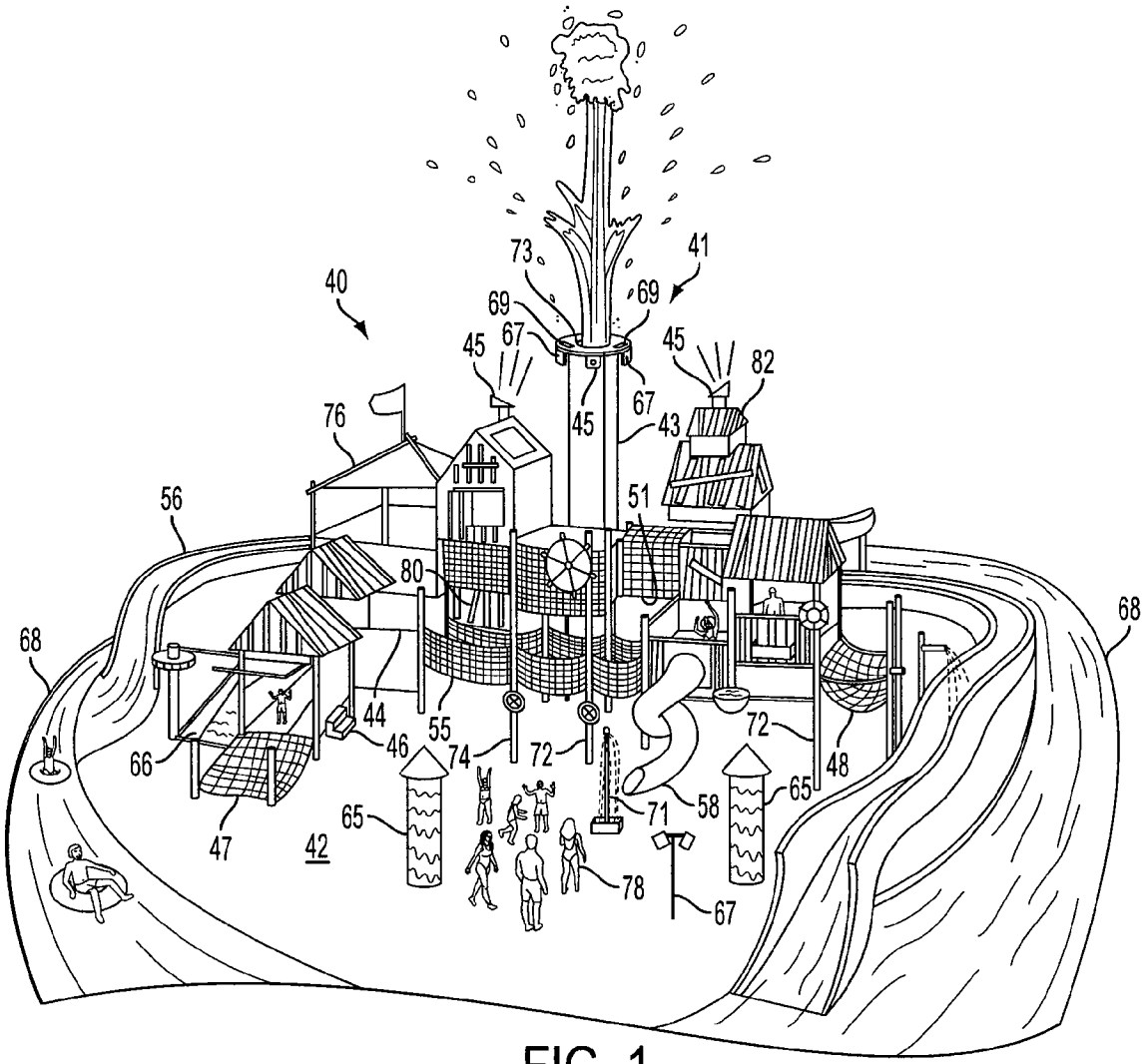
FIG. 1 illustrates a front perspective view of a participatory water play system having features of the present invention.

The present invention relates to an interactive water play structure, a water eruption effect device, light towers, and responsive water play devices. The disclosure of U.S. Pat. No. 5,820,471, titled "Participatory Water Play System," directed to a participatory water play system, is hereby incorporated by this reference.

FIGS. 1-4 illustrate one embodiment of a participatory water play system having features of the present invention. This particular water play system is provided in the form of an island wilderness treehouse, as shown. Of course, those skilled in the art will readily appreciate that this participatory water play system is not limited to this one embodiment, but may be implemented in accordance with a wide variety of other possible exciting play themes. For example, the participatory water play system may equivalently have a pirate ship theme, a sub-mariner theme, a medieval castle theme, a lost temple theme, a fire station theme, or the like.

The play system comprises a water play structure 40 having multiple levels, or surfaces, and/or platforms 42, 44 between which play participants 78 can traverse using stairs 46, ladders or climbing nets 47, 48, crawl tunnels 49-54, and swinging bridges 55. Slides 56, 58-64 originating from the higher levels 44 of the water play structure 40 can quickly bring the play participants 78 down to the ground surface, or ground level 42 or can deposit the participants into an adjacent pool 66 or an optional river loop 68 which surrounds the water play structure 40.

The water play structure 40 incorporates a variety of participatory water play elements and non-water play elements spaced at predetermined or random intervals. Support for the water play structure 40 is provided by a supporting framework 72 comprising primarily water carrying conduits 74 and non-water carrying framing elements 76. Conduits 74 are preferably selected to be of sufficient size and strength to support the water play structure 40 and play participants 78 while also supplying water to the various interconnected water play elements.

Preferably, the conduits 74 are formed from hollow steel pipes that are adapted to be bolted or welded together using commercially available pipe fittings. Standard schedule 40 galvanized steel pipe having an outside diameter of between 4 and 8 inches and a wall thickness of between about ⅛ and ½ inches should be suitable for most applications. Alternatively, some or all of the conduits 74 may be formed from other suitable materials such as pvc pipe, copper pipe, or clay/ceramic pipe, as desired. In addition, the conduits 74 may be formed from schedule 10 stainless steel or other equivalent non-corrosive materials.

Framing elements are selected to support non-water play elements and/or to provide additional support for roofing and other optional structures, as desired. Framing elements 76 may be constructed of any convenient material having adequate strength, durability and resistance to corrosion. Aluminum or wood framing elements, galvanized structural steel, pvc pipe, schedule 10 stainless steel, or any other corrosion-resistant material may be used, as desired, to provide additional support for the water play structure 40 and play participants 78.

It will be apparent to those skilled in the art that a variety of other possible framing designs may be used for constructing the supporting framework 72. For example, supporting framework 72 may be constructed substantially entirely of non-water carrying framing elements 76. In that event, water may be provided to the various water effects by separate plumbing conduits that are external or internal to the framing elements 76. It is preferred, however, that water carrying conduits 74 be used for forming substantial portions of the supporting framework 72 in order to reduce material costs and to provide fast and easy construction.

For visual appeal, optional decorative panels and/or roofing elements may be provided, as desired, to complement the particular desired theme of the water play structure 40, to shade play participants from the sun or to prevent play participants from falling off the water play structure 40. For instance, in the embodiment shown, wooden railings 80 and wood-paneled roofs 82 are provided for added rigidity and/or shelter, and to complement the theme of an island wilderness tree house. These optional panels 80, 82 may be made from wood, fiberglass, reinforced fabric, PVC, or other corrosion-resistant materials, as desired.

In the particular embodiments shown, pressure treated wood is used because of its high durability, low cost, and pleasing outward appearance. Those skilled in the art will readily appreciate that a wide variety of other decorative or thematic elements may be incorporated into the overall design in order to convey a particular desired play theme.

FIG. 1 displays a water eruption effect device 41 that may comprise an eruption effect support structure 43, a water eruption jet 73, and multiple associated devices positioned throughout the water play structure 40. The associated devices may include lighting devices 45, light towers 65, sound devices 67, mist or smoke devices 69 and fountain devices 71. These associated devices 45, 65, 67, 69 and 71 may be positioned on the eruption effect support structure 43 and/or throughout the water play structure 40.

The eruption effect support structure 43 may comprise a columnar structure, generally shaped as a tower as shown in FIG. 1, which elevates the water eruption jet 73 into the air above the water play structure 40. The eruption effect support structure 43 has a lower end configured to rest on a lower surface (which may be the ground, a platform, or the like) and an upper end extending upward from the lower surface. The eruption effect support structure 43 is therefore elevated from the lower surface upon which it, and the water play structure 40, rests. The water eruption jet 73 is positioned at the upper end of the eruption effect support structure 43. Depending upon the desired effect to be created, while not necessary, it may be desirable for the eruption effect support structure 43 to have a height sufficient to raise the water eruption jet 73 above the roofs 82 of the water play structure 40, which may be on the order of 50 feet, depending on the height of the water play structure roofs 82. Similarly, the eruption effect support structure 43, if desired, may be positioned centrally within the water play structure 40, such that the structures forming the play structure 40 extend radially around the support structure 43.

The water eruption jet 73 may be positioned at the top of the eruption effect support structure 43. The jet 73 comprises a mechanism that expels a large quantity of water above the water play structure 40 at timed intervals. The quantity of water expelled may be to the order of approximately 100 gallons, or any amount depending upon the desired effect, application, and/or size of the water play structure 40, and may be expelled at an interval, for example, of 10 minutes, or at other time intervals as desired, either predetermined or random. For example, in the embodiment shown in FIGS. 24 and 25, the water eruption jet 873 may include continuous-stream water fountains 81 capable of emitting over about 1000 gallons per minute, and air-driven water jets 84 capable of emitting over about 40 gallons of water into the air at once. The water eruption effect device 41 may also include multiple water eruption jets 73, without deviating from the scope of this invention. Once the water is expelled from the water jet 73, it falls down towards the lower surface upon which the eruption effect support structure 43 rests, to thereby soak, entertain, and cool individuals positioned near water eruption jet 73 and the lower end of the support structure 43.

The lighting devices 45 may be positioned on the eruption effect support structure 43, and/or on the roofs 82 of the water play structure 40, and/or on the ground level 42 of the play structure 40. The lighting devices 45 comprise standard LED or incandescent lights made waterproof to protect them from the water expelled from the water eruption jet 73 and the other water play elements associated with the play structure 40. The lighting devices 45 may be directed to illuminate towards the eruption effect support structure 43, or may generally be directed towards the air, land, or other parts of the water play structure 40. Lighting devices 45 may also be placed within the nozzles of the fountain devices 71 or the water eruption jet 73, to illuminate a stream of water emitted by these devices from within.

Figure 18:
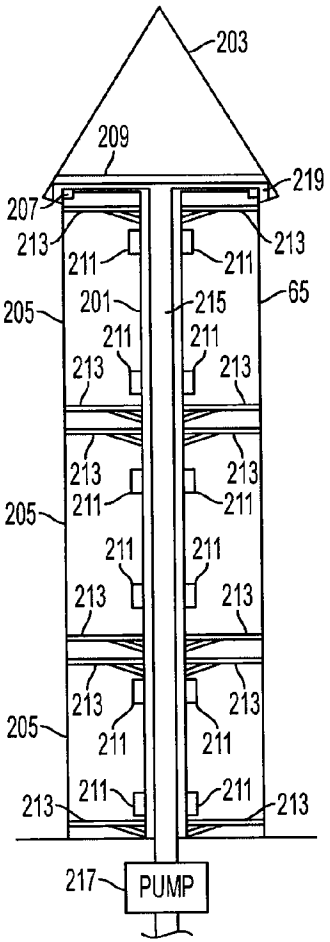
FIG. 18 illustrates a side schematic view of a light tower according to one embodiment of the present invention.
Figure 17:
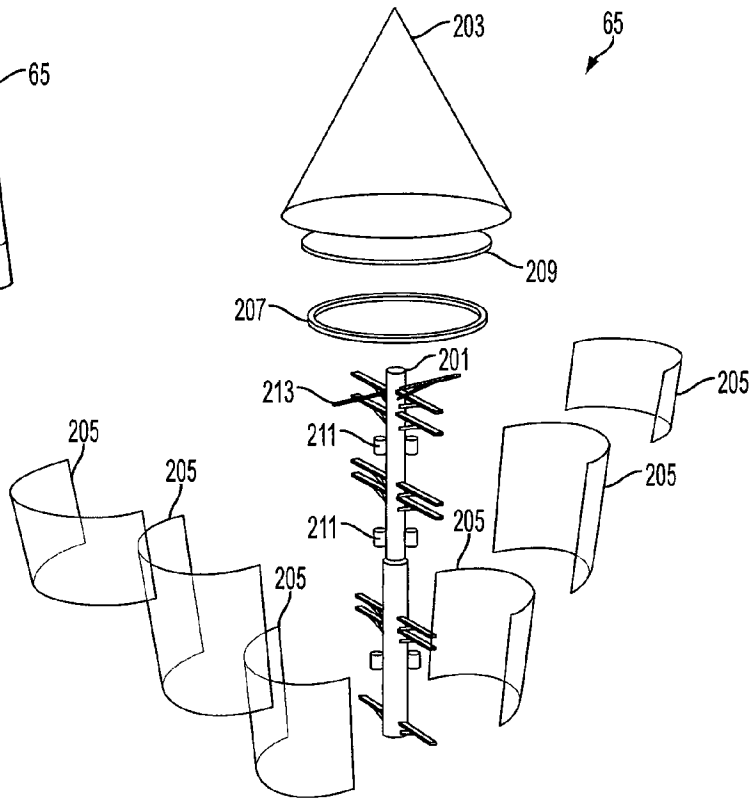
FIG. 17 illustrates an exploded perspective view of a light tower according to one embodiment of the present invention.
Figure 16:
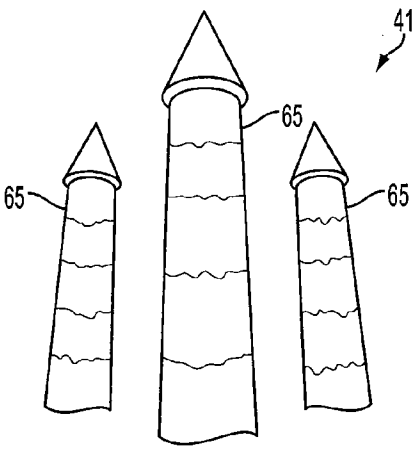
FIG. 16 illustrates a perspective view of light towers according to one embodiment of the present invention.

The light towers 65, also shown and described in relation to FIGS. 16-18, comprise lighted columnar structures extending up from the floor level 42 of the water play structure 40, or from an elevated lower surface. The light towers 65 may be positioned scattered throughout the water play structure 40, or may be positioned in an ornamental configuration (e.g., a circle or animal-like design, or the like), or may be placed on top of the structures forming the water play structure 40. A stream of water flows down the outer surface of the light tower 65. The light towers 65 are illuminated, causing the light to pass through the stream of water flowing down the outer surface of the light tower 65.

The sound devices 67 comprise sound speakers positioned on the eruption effect support structure 43 and/or throughout the water play structure 40, including on the ground, in trees, buildings, or in adjacent water play structures 40. If the sound devices 67 are positioned on the floor level 42 of the play structure 40, a speaker stand may support and house the sound devices 67. The speakers are made waterproof to protect them from the water ejected by the water eruption jet 73 and the other water play elements associated with the water play structure 40.

The mist or smoke devices 69 are capable of outputting a water mist spray and/or a smoke spray, and may be positioned on the eruption effect support structure 43, and/or throughout the water play structure 40 including on the ground, in trees, buildings, or in adjacent water play structures 40.

The fountain devices 71 emit a plume of water, either continuously or intermittently into the air. The lighting devices 45 may shine onto the fountain devices 71, and/or the fountain devices 71 may be lit from within (e.g., a light shining along the interior of the column of water emitted by the fountain device). The fountain devices 71 may be positioned on the eruption effect support structure 43, and/or throughout the water play structure 40. The fountain devices 71 may emit a stream of water to a height on the order of 10-30 feet, although this height may vary, as desired, without deviating from the scope of this invention.

In operation, the water eruption effect device 41 produces a water eruption effect designed to imitate the eruption of a geyser, a volcano, a gushing oil derrick, the bubbling over of a water fall, a dam flood, or the like. To produce the eruption effect, the water eruption effect device 41 engages in a sequence of actions intended to initially build anticipation for the eruption, and then to simulate an eruption. In this sequence, initially, the water eruption jet 73, or a plurality of water eruption jets 73, may not emit any water, or may emit a proportionally small amount of water relative to the total output capacity of the water eruption jet 73. During this time, the play participants 78 may be scattered throughout the water play structure 40 playing with the assorted non-water play and water play elements. This initial period of time may extend for a defined duration, as desired. In the embodiment shown in FIG. 1, the duration may be approximately 8 minutes, although this duration may be varied without deviating from the scope of this invention. At the end of this initial time period, the water eruption effect device 41 may enter a second period that indicates a water eruption is about to occur.

In the second period, the coming eruption may be indicated by a series of random events, or may be indicated by a progressive series of events. In the random series of events model, components of the water eruption device 41 may start to activate, for example, the lighting devices 45 may start to blink sporadically, and the sound devices 67 may emit rumbling sounds intermittently. The fountain devices 71 may start to light up with different colors, or may emit a stream of water at different heights. The mist or smoke devices 69 may start to emit mist and/or smoke. The light towers 65 may start to flash, and/or may emit different colors. Generally, during this second period, the activity of the water eruption effect device 41 components will change, indicating that an event is about to happen. In addition, the water eruption jet 73, or multiple water eruption jets 73 may start to vary the amount of water emitted by the jet 73, increasing or decreasing the volume of water emitted by the jet 73. In addition, any lighting element shining through water emitted by the jet 73 may start to change intensity and/or color. A single effect or a combination of effects may occur to indicate a coming eruption.

In the progressive series of events model, the activity of the water eruption effect devices will gradually increase to indicate a coming eruption. For example, the intensity of the lighting devices 45, or the flashing frequency of the lighting devices 45 may gradually increase to build up to an eruption. The colors of the lights may gradually turn to a designated color to indicate a coming eruption, for example a red color for a volcano themed effect. In addition, the sound devices 67 may increase the volume or repetition rate of sounds indicating a coming eruption. A countdown may start counting from the sound devices 67. The mist or smoke devices 69 may increase in output. The light towers 65 may act similarly as the lighting devices 45 (e.g., changing colors, light intensity, and/or may flash lights). The fountain devices 71 may change in color of light intensity or change flow direction or intensity. The water eruption jet 73 may output an increased stream of water.

A single effect or a combination of effects may produce this progressive build-up for the eruption. In addition, a combination of the random series of effects and the progressive series of effects may be used to build anticipation for the eruption. This second period may extend for a defined duration of time, as desired. In the embodiment shown in FIG. 1, this duration may last approximately 2 minutes, although this duration may vary without deviating from the scope of this invention.

The second period is intended to build anticipation for the eruption by notifying play participants 78 that an eruption is about to occur. A progressive build-up may notify the participants 78 of the exact time the water eruption will occur, whereas a more random build-up may make the exact eruption time a surprise.

The eruption effect will then move into the third phase, wherein the water eruption jet 73, or multiple water eruption jets 73 will emit a large quantity of water over the water play structure 40 at once. The amount of water expelled can be any amount depending upon the desired effect, for example whether the water play structure 40 is used in an indoor application, and/or may vary relative to the size of the water play structure 40. The amount of water emitted can be as little as 10 gallons or as much as several thousand gallons. In the embodiment shown in FIG. 1, the amount of water emitted is preferably in the range of 40 to 120 gallons, as ejected by an air-driven water jet. Similarly, depending upon the desired effect and application of the water play structure 40, and the height of the support structure, the water may be expelled to a height of as little as a few feet or in excess of a hundred feet. The quantity of water will erupt and/or bubble, putting water into the air over the water play structure 40, landing on the play participants 78 and getting them wet. The eruption effect may last for 1-2 minutes, although this duration may be varied without deviating from the scope of this invention. The water eruption effect device 41 may then return to the initial state. The three-part eruption cycle may occur over a defined time duration. In the embodiment shown in FIG. 1, the total duration of the eruption cycle may be 10 minutes, although this timing may vary without deviating from the scope of this invention (e.g., every 30 minutes or every hour). The eruption cycle and the order of the phases of the eruption cycle may also be varied (e.g., an eruption may be followed directly by another eruption, or an eruption may be followed by a build-up stage, followed by another eruption), without deviating from the scope of this invention. In addition, the eruption cycle may only include one, or two, or three phases, or may include a combination of phases forming a more than three phase eruption cycle. The order and/or duration of the cycle may vary randomly or at predetermined rates.

The purpose of the water eruption effect device 41 is to provide a way to entertain, cool, and/or soak play participants 78 and also to promote the eruption as a show. Participants 78 may become excited about the event and will wait around the water eruption jet 73 hoping to get wet or to watch the display. In addition, the plume of erupted water, potentially launched to a height of over 100 feet, will provide increased visibility for the play structure 40 from outside the park. For example, a potential customer driving on a nearby highway may see the plume of ejected water and may be drawn to the play structure 40.

In addition, the plume of water emitted by the water eruption jet 73 or multiple water eruption jets 73 need not be directed directly up, vertically, into the air or be directed to spray evenly around the entire water play structure 40. The water eruption jet 73 may be controlled and/or directed to spray water in multiple directions, as desired. However, due to gravity, the water emitted from the water eruption jet 73 will fall down towards the lower surface upon which the eruption effect support structure 43 rests, to cool and soak individuals. Such individuals may even be positioned on an elevated surface near the water eruption jet 73. For the purposes of this application, individuals are "near" the water eruption jet 73 when they are within an outward radius of at least about 30 feet from the water eruption jet 73 or the lower end of the eruption effect support structure 43.

The direction, position, and flow of the water eruption jet 73 may be controlled as desired to accommodate the structure, position, use, and size of the water play structure 40.

In addition, the water eruption effect device 41 may provide a show element for the water play structure 40 during night-time operation. The lighting devices 45 positioned outside or within the water eruption jet 73 and fountain devices 71, and also the light towers 65 may be used to illuminate the eruption device 41. Thus, the show element of the eruption effect may continue during night-time. The night-time utility of the present invention may extend use of the park beyond traditional day-time operating hours, and may provide use during the off-season.

Figure 2:
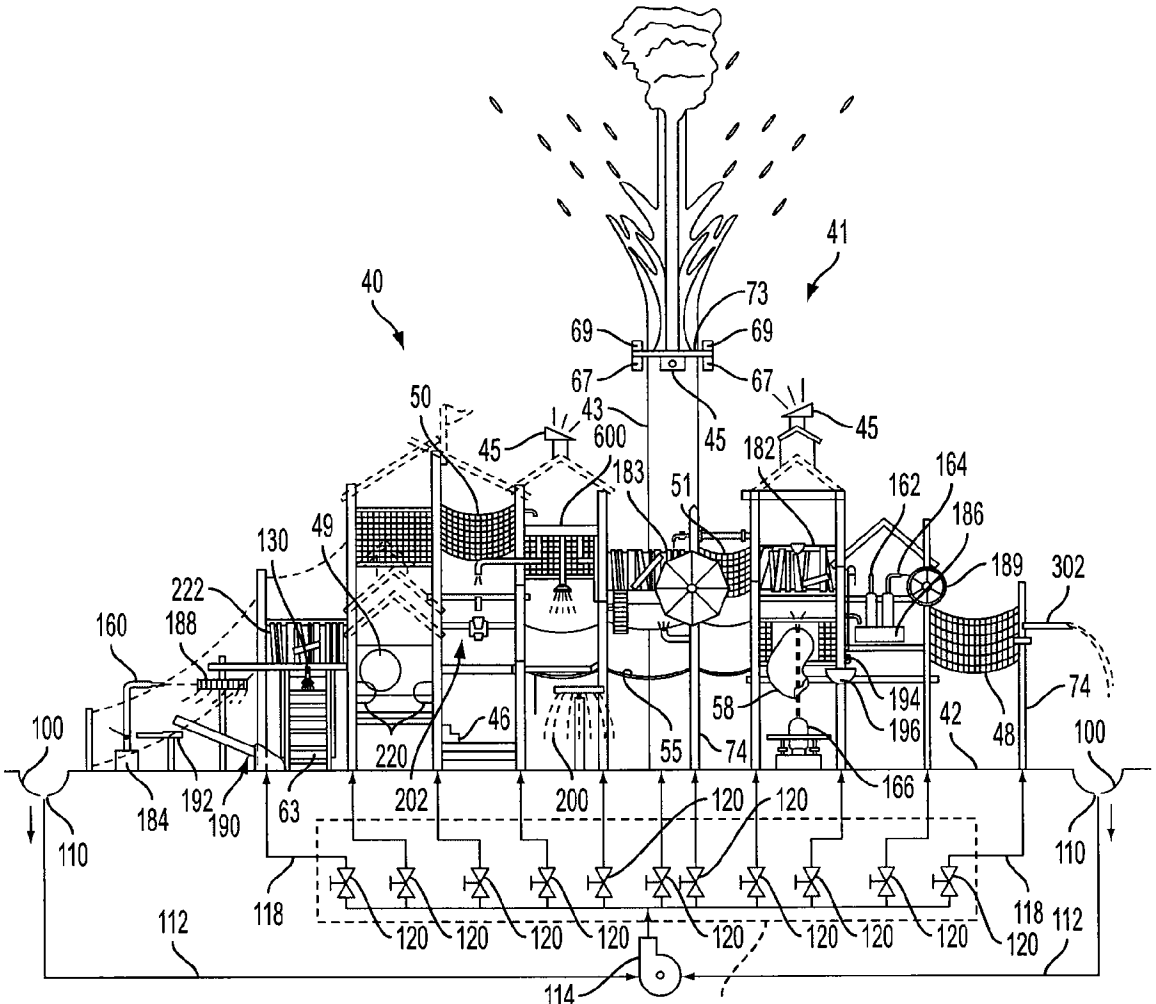
FIG. 2 illustrates a front elevational view and schematic plumbing diagram of the participatory water play system of FIG. 1.

FIG. 2 is a front elevational view and plumbing schematic of the participatory water play system of FIG. 1. As indicated in the plumbing schematic, water under pressure is provided to the various supporting conduits 74 by a system of subterranean plumbing conduits running underneath the water play structure 40. A basin 100 is provided underneath or adjacent the play structure 40 for collecting water runoff. Drains 110 are located at various locations around the water play structure 40 in order to collect the run-off water. The precise number and location of drains 110 may be varied, as desired, according to the size of the water play structure 40 and the contour of the underlying terrain.

It will be appreciated that run-off water flows into the various drains 110 of the water play structure 40, through the collection lines 112 to the inlet port of a recirculation pump 114. Those skilled in the art will appreciate that the pump 114 may comprise any one of a number of commercially available pumps, or a series of pumps, for pumping or recirculating water. An end-suction centrifugal or vertical turbine type pump having a capacity of between about 1000 and 3000 gpm and a maximum head of between about 30 and 60 feet of water should be sufficient for most applications, which may be made smaller or larger depending on the configuration and use of the water play structure 40.

The pump 114, or series of pumps 114, supply the recirculated water at a predetermined head to a master control valve manifold 116, as shown. The manifold 116 is adapted to safely deliver the returned water via return conduits 118 to each of the vertical support conduits 74. The pump 114 may additionally be used to supply water to one or more of the water eruption jets 73. Advantageously, the flow rate of water delivered to each of the vertical support conduits 74 may be adjusted via control valves 120 for safely supplying recirculated water to the various interconnected water effects. Those skilled in the art will readily appreciate that the above construction provides efficient reuse of water. This is desirable because, among other reasons, it reduces operating costs, promotes water conservation and avoids possibly damaging runoff water.

The vertical support conduits 74 provide water under pressure to other interconnected conduits 74 which, in turn, supply water to a variety of interconnected water forming devices and water play elements. As used herein, the term "water forming device" will refer to a nozzle or other device from which water may be caused to issue. The term "water play element" will refer to any play element that uses water and that may be manipulated or controlled by one or more play participants to create a desired water effect, such as spraying, spilling, bubbling, pouring, or splashing water. Water play elements shown in FIGS. 1-4, may include, for instance, adjustable water jets or spray nozzles 130-144, pump guns or geysers 160, 162, 164, 166, 168, rotating spiraling spouts 180, tipping buckets 182, 202, tipping tray 183, or a variety of other water effects for spraying play participants or producing various water effects.

Multiple order or delayed water effects provide further challenge and excitement for play participants. For example pump guns 160, 162, 164 allow play participants to pump water from a pump basin or tub 184, 186 to form a cohesive stream of water which may be directed onto other unsuspecting play participants or may be directed to impact rotatable water wheels 188, 189, causing various desired water effects. Before the pump guns 160, 162, 164 can be activated, however, it is first necessary to provide the guns with the required "ammunition" by filling the pump basins 184, 186 with water. This may be done for instance by manipulating another valve or by operating an adjacent water effect, such as the archimedes screw pump 190 and rotatable aqueduct or trough 192, in order to fill the pump basin 184. Other play participants may form a bucket brigade using a rope-and-pulley operated bucket 194 to hoist water up from a lower basin 196 to fill the pump basin 186, which supplies the pump guns 162, 164.

In this manner, it will be appreciated that the pump guns 160, 162, 164 are "second order" water effects in that they depend on at least one other water effect to supply the guns with water. Similarly, the rotatable wheels 188, 189 are "third order" water effects in that their operation depends on two other water effects being operated either simultaneously or in secession. These rotatable wheels 188, 189 may operate or enable the operation of yet other pumps or water play elements in order to create even higher order water effects for surprising and entertaining other unsuspecting play participants. Those skilled in the art will appreciate that the number and variety of such multiple order water effects are virtually unlimited.

Other multiple order water effects may include, for instance, a pump geyser 166 for creating a vertical jet of water, a spinning water tray 200 for flinging water by centrifugal force, tandem tipping buckets 202 for showering play participants on lower levels, as well as a variety of other water effects which will be described in more detail below. Semi-active or passive water play elements, such as waterfalls 204, or funnels 208 may also be used, as desired, for creating special visual effects or intermittent or random water effects for complementing a particular play theme, cooling play participants or simply adding to the overall excitement of the water play system.

Elements of the water eruption effect device 41 are also shown in FIG. 2, including the eruption effect support structure 43, lighting devices 45, sound devices 67, and mist or smoke devices 69. The eruption effect support structure 43 is positioned centrally within the water play structure 40. Control valves 120 supply water to the eruption effect support structure 43 for use with the water eruption jet 73. Although the water eruption jet 73 is shown positioned centrally within the play structure 40, the water eruption jet 73 may also be positioned to one side or away from the play structure 40 without deviating from the scope of this invention. Although the water eruption jet 73 may be to one side of the water play structure 40, it is considered to be within the play structure 40 if it is of a distance from the play structure 40 that patrons of the play structure 40 will be splashed by water emitted during the eruption effect.

The water play structure 40 also incorporates a number of non-water play elements shown in FIGS. 1-4, such as climbing nets 47, 48, webbed crawl tunnels 49-54, swinging bridges 55, and slides 56, 58-64. These provide for entertaining physical challenges as well as allowing play participants to negotiate their way through the various levels and platforms of the water play structure 40. For instance, a through tunnel 49 allows play participants to reach the rear of the play structure 40 from the front or vice-versa. The swinging bridge 55 allows play participants to traverse between the right and left sides of the water play structure 40. It is also contemplated that some bridges may also be non-swinging bridges. The use of hand rails 220, enclosure panels 222, and non-slick surfaces assists participants in moving throughout the water play structure 40. Those skilled in the art will readily appreciate that a wide variety of other water and non-water play elements, such as funny mirrors, rotating tunnels, trampolines, climbing bars, etc., may also be incorporated into an interactive play system in accordance with the present invention, as desired.

Figure 3:
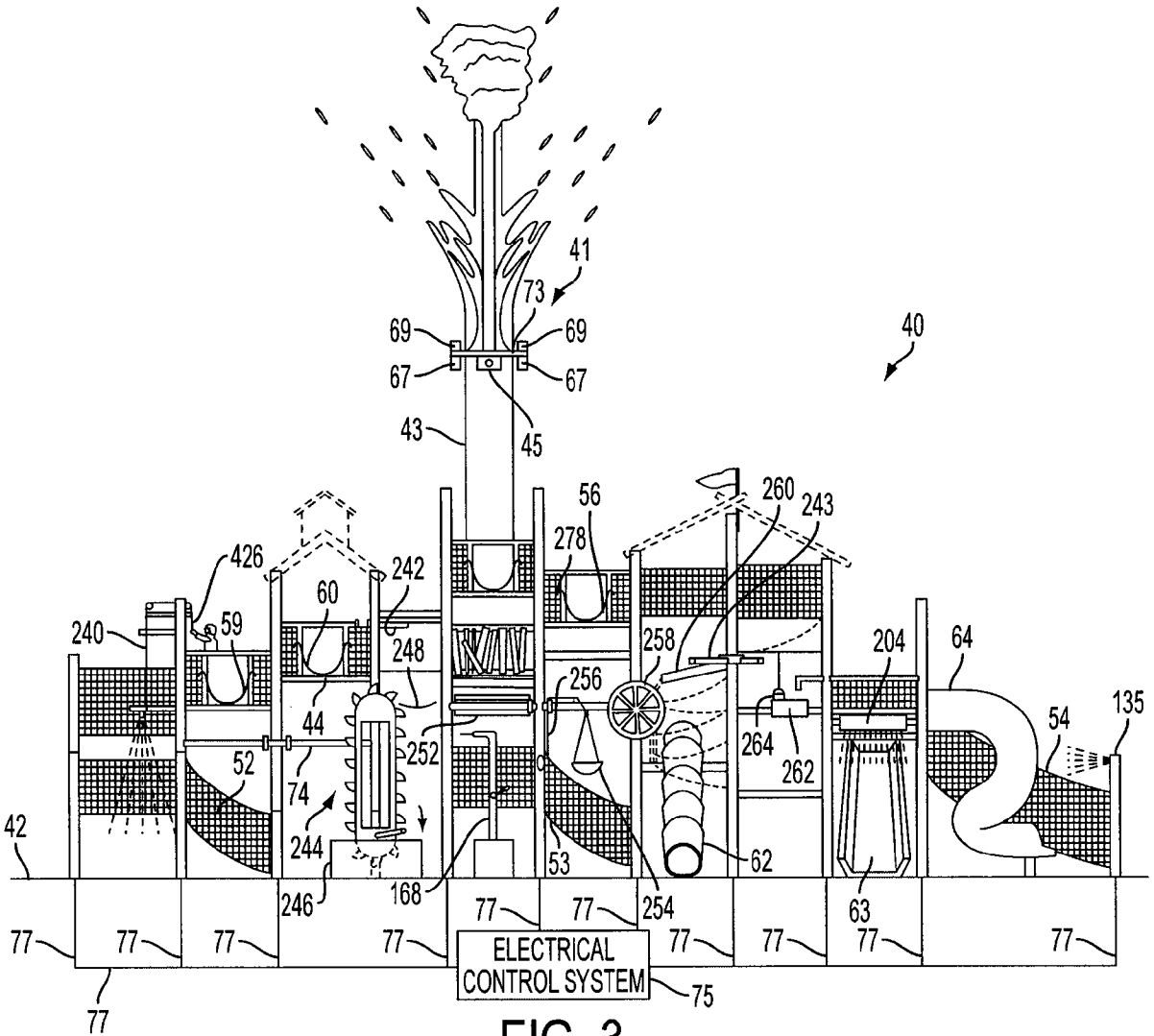
FIG. 3 illustrates a rear elevational view and schematic electrical diagram of the participatory water play system of FIG. 1.

FIG. 3 is a rear elevation view of the participatory water play system of FIG. 1, illustrating additional water and non-water play elements. Starting from the left, a pull-chain activated overhead spray nozzle 240 is provided for showering play participants climbing through a crawl tunnel 52. Further to the right, pairs of trays or runnels with central sliding dams 242, 243 allow participants to choose which runnel to allow water to flow down onto others below, by sliding the dam to the opposite runnel. A bucket conveyor 244 is provided for lifting water from a lower basin 246 to an elevated aqueduct or trough 248 for supplying subsequent troughs 249, 251 or other water effects, described later. A pump gun 168 is provided for spraying a stream of water onto other play participants. Above the pump gun 168, a rain jet 252 is provided for selectively raining water down on play participants below. A hanging colander 254 is further provided which may be filled by a pull-chain activated nozzle 256. Water wheel 258 is activated by water flowing down a sloping runnel 260 which, in turn, is fed by hoisting water from a lower basin 262 using a rope-and-pulley operated bucket 264.

Throughout the water play structure 40, slide entrances are provided for entering the various slides 56, 58-64. Enclosure panels or netting 278 is preferably provided around the various entrances to the slides 56, 58-64. Again, webbed crawl tunnels 52-54 and climbing nets 48 interconnect the various areas and levels of the play structure 40, as shown, to provide for travel on and about the play structure 40.

FIG. 3 further illustrates an electrical control system 75 connected to the water play structure 40 via connection lines 77 that are capable of transmitting power and control signals to the water play structure 40, and capable of transferring signals from the water play structure 40 to the electrical control system 75. The electrical control system 75 may be used to power and control numerous devices associated with the water play structure 40, including the water eruption effect device 41 (e.g., the lighting devices 45, the sound devices 67, the mist or smoke devices 69, the light towers 65, and fountain devices 71, shown in FIG. 1, and the water eruption jet 73). The electrical control system 75 may also be used to coordinate the series of events leading up to the eruption, and may coordinate the actual eruption itself. Furthermore, the electrical control system 75 may also control the operation of the responsive water play devices 79 described in relation to FIGS. 21-23. Electrical control system 75 may comprise a single centralized control unit, a plurality of independent control units, a network of control units, or combinations thereof. The electrical control system may be programmed by operators of the water play structure 40 to set the types of activities performed by electrical control system 75. The connection lines 77 may be integrated within the framing elements 76, the water carrying conduits 74, and the supporting framework 72 to deliver electrical power and control throughout the water play structure 40. It is also contemplated the electrical control system 75 may not be utilized in some embodiments of the present invention.

Figure 4:
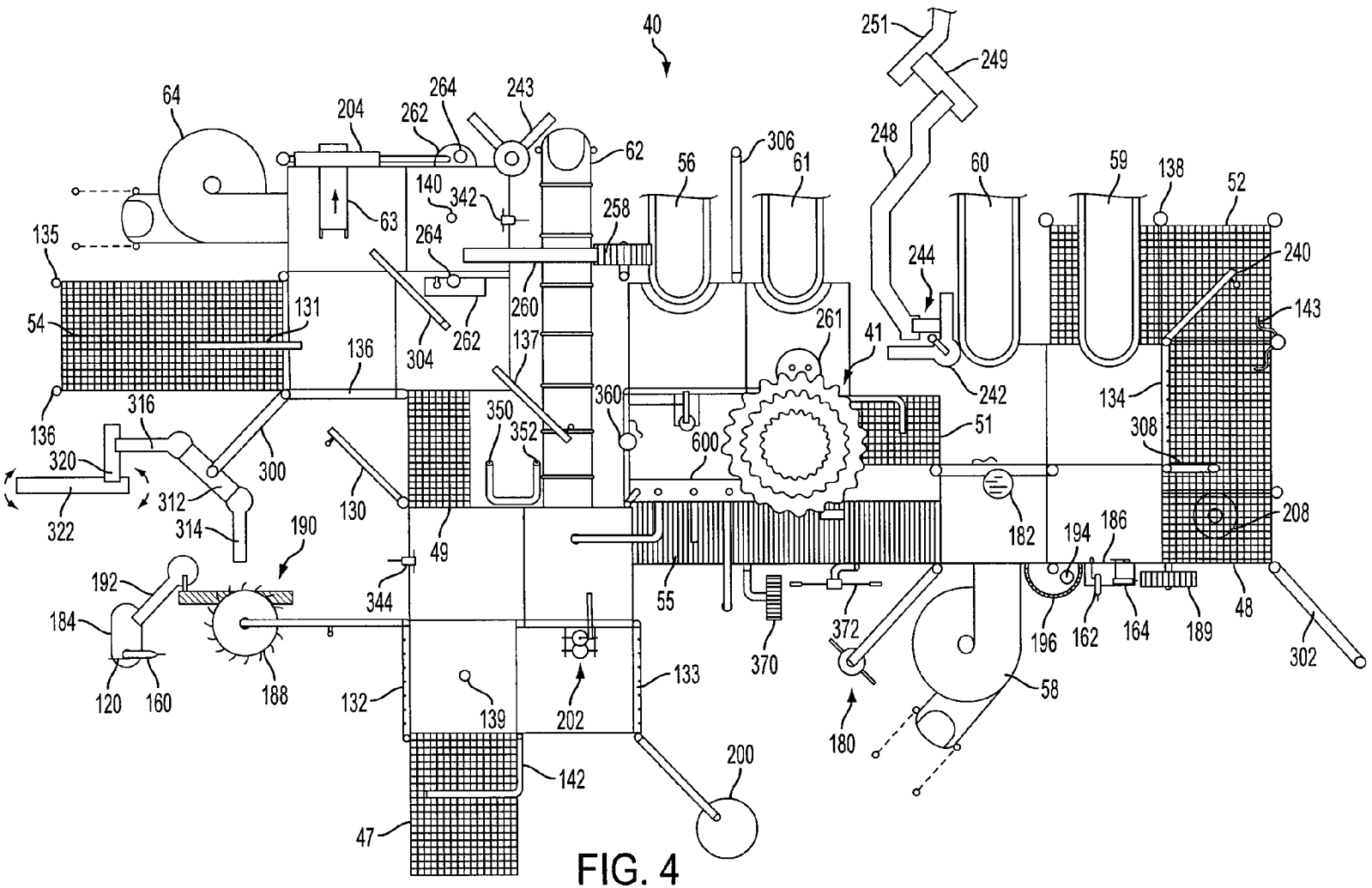
FIG. 4 illustrates a plan view of the participatory water play system of FIG. 1.

FIG. 4 is a plan view of the interactive water system of FIG. 1, showing in more detail some of the water play elements shown in FIGS. 1-3. As indicated, dry and water slides 56, 58-64 are provided at the front, rear, and/or sides of the play structure 40. The slides 56, 58-64 may be straight, somewhat curved, or spiral-shaped in design, as shown. They may also be enclosed and tube-like, as shown, or open and exposed to water spray, as desired. Alternatively, those skilled in the art will readily appreciate that the size, number and location of the various slides 56, 58-64 can be varied, as desired, while still enjoying the benefits and advantages of the present invention.

A plurality of participant activated pipe falls 300, 302, 304, 306, 308 are provided throughout the water play structure 40 for delivering water to various other multiple order water effects. One such pipe fall 300 delivers water to a tipping tray 312 which, in turn, may be positioned to deliver water to either the archimedes water screw 190 or to another series of tipping trays 314, 316 and rotatable troughs 320, 322 to create various delayed water effects. The latter can be adjusted to carry the water to remote locations such as the surrounding river loop 68. With careful planning and timing, a play participant can adjust the various tipping trays 312, 314, 316 and rotatable troughs 320, 322 to douse other unsuspecting play participants floating along the outer river loop. This encourages experimentation and learning through hands on operation of the various water play elements.

Behind the tipping trays 312, 314, 316 and rotatable troughs 320, 322 is a climbing net 54 and various spray nozzles 131, 135, 136 for selectively spraying water onto play participants climbing on the net 54. Diagonal from the climbing net 54 is provided a small slide 63 which exits through a water curtain 204. Water guns 342, 344 are provided at various locations throughout the play structure for shooting at play participants. These may either be pump guns similar to the ones described above, or they may be continuous, direct-feed guns, as desired. Preferably, at least some of the water guns 342, 344 are adapted to rotate so that they can shoot water in various directions.

A through tunnel 49 is provided from the front of the play structure to the rear, as shown. The tunnel 49 may be constructed of a relatively hard material such as a clear plastic or fiberglass, or, more preferably, it may be constructed of a soft webbing material, as indicated. The tunnel 49 terminates next to a slide 62, which exits through the back of the water play structure 40, as shown. Various nozzles 137, 350, 352 are provided adjacent the tunnel 62 for spraying water onto play participants climbing in and around the tunnel 62.

Various tipping buckets 182, 360, 362 are provided on the upper levels around the water play structure 40 which may be filled via an adjacent nozzle and then dumped onto play participants below. Preferably these buckets are pivotably connected to the play structure 40 by a hinge or axle so as to facilitate spilling of water from the buckets 182, 360, 362, while preventing removal of the tipping buckets and possible resulting injury. Tipping buckets 182, 360, 362 may be constructed of any convenient material, such as wood, galvanized steel, or fiberglass, as desired. Tandem tipping buckets 202 provide an added degree of skill and excitement as play participants can fill a first tipping bucket and then spill its load into second bucket, causing the second bucket to spill over or drop water onto play participants below.

Several horizontally or vertically mounted water wheels 188, 189, 258, 370, 372 are also provided throughout the play structure 40, as shown. As briefly described above, these may be activated by adjacent water effects, such as water guns 342, 344, water pumps 160, 164, 168, or runnels 260, whereby a stream of water is caused to impinge upon paddle surfaces or other impact surfaces located on or near the periphery of the water wheel 88. Alternatively, one or more of the water wheels 188, 189, 258, 370, 372 may be adapted to be operated by a nozzle or other water forming device internal to the water wheel itself. A sink with a plugged outlet 261 may be unplugged to douse participants in the tunnel 51. One or more spiraling spouts 180 may also be provided to rotate and spray water in a circular or spiraling pattern, as desired.

A variety of other water forming devices, such as overhead spray jets 130, 131, arch jets 132-134, horizontal jets 135, 136, rain jets 137, peacock jets 138, geyser jets 139-141, bar jets 142, and hose jets 143, 144, are provided throughout the play structure 40, as shown, in order to allow play participants to cool off and/or douse one another with water spray in a fun and entertaining way. Control valves and actuators 256, 426, for example, for the various water forming devices, may be operated by play participants to control the flow of water issuing from the various water forming devices. Control valves may include, for example, wheel-controlled butterfly valves, lever-controlled butterfly valves, counter-weight valves, gate valves, flush valves, wheel-controlled ball valves, lever-controlled ball valves, and any number of other control valves well know to those skilled in the art. Actuators may include pump levers, hand cranks, pull chains, and other actuators well known to those skilled in the art.

FIG. 4 also illustrates the position of the central water plume of the water eruption effect device 41 in relation to the water play structure 40. In this embodiment, the support structure 43 is positioned centrally relative to the water play structure 40, to assure maximum dispersion of the water from the eruption plume over the structure 40. However, it is also contemplated the support structure 43 may be positioned to one side of the support structure, as discussed above.

Figure 5:
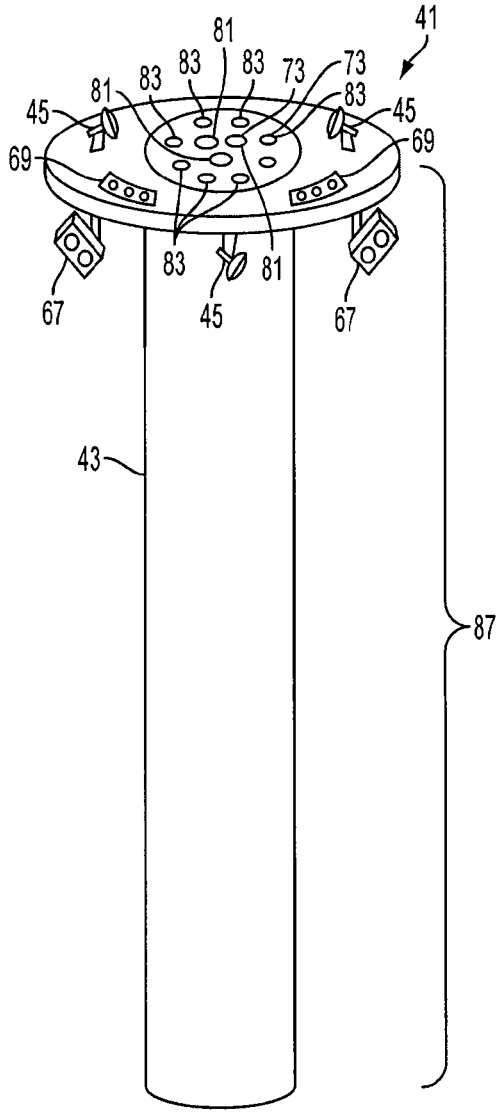
FIG. 5 illustrates a front perspective view of one embodiment of components of the water eruption effect device.

FIG. 5 illustrates a perspective view of the eruption effect support structure 43, the water eruption jet 73, and eruption effect devices features 45, 67, 69 positioned on the eruption effect support structure 43. The eruption effect support structure 43 houses the water eruption jet 73 and elevates it to a height 87, preferably about 50 feet above the ground level 42 of the water play structure 40. This height 87 may be varied without deviating from the scope of this invention, for example, the height 87 may be between 10 and 100 feet. In the embodiment shown in FIGS. 24 and 25, the top of the eruption effect support structure 43 has a height of approximately 15 feet. The support structure 43 shown in FIG. 5 has a columnar shape, particularly a tower shape, but may also have any other shape capable of equivalently housing and elevating the water eruption jet 73, and/or directing the flow of the plume emitted from the water eruption jet 73. At one end of the support structure 43, an effect support 85 (more clearly shown in FIG. 6) may be used as an attachment point for the eruption effect device features 45, 67, 69, described above in relation to FIG. 1, and capable of adding to the eruption effect (e.g., with flashing lights, mist, and erupting sounds).

The water eruption jet 73 comprises a combination of two different types of water fountain devices, specifically a group of primary continuous-stream water fountains 81 and a group of secondary air-driven water jets 83 coupled to the upper end of the eruption effect support structure 43. A single primary continuous-stream water fountain 81 or a single secondary air-driven water jet 83 may also be utilized. The primary continuous-stream water fountains 81 are fountains capable of ejecting a continuous stream of water via a pump system for an indefinite duration. The term "continuous stream" refers to a stream that is emitted continually, although the stream of the fountain 81 may be entirely eliminated, or shut-off, at some point. The continuous stream is distinguished from a jet that may emit a defined burst of water contained within a reservoir at a given time, such as the secondary air-driven water jets 83.

The secondary air-driven water jets 83 comprise fountains capable of ejecting a large single burst of water at a specified time. The secondary air-driven water jets 83 include a reservoir that is filled with a large quantity of water, which is then ejected out of the reservoir with pressurized air. In the water eruption jet 73 configuration shown in FIG. 5, the secondary air-driven water jets 83 surround and encircle the primary continuous-stream water fountains 81 in a circumferential pattern.

Figure 5A:
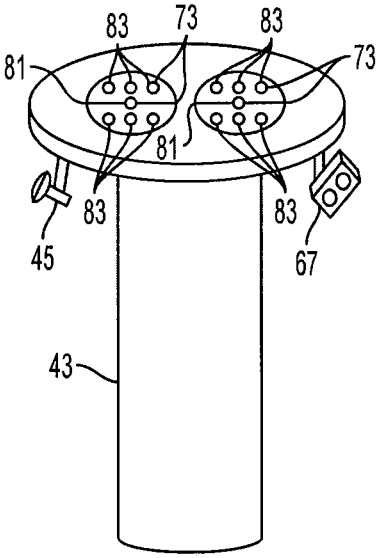
FIGS. 5A-5D illustrate front perspective views of embodiments of components of the water eruption effect device.
Figure 5B:
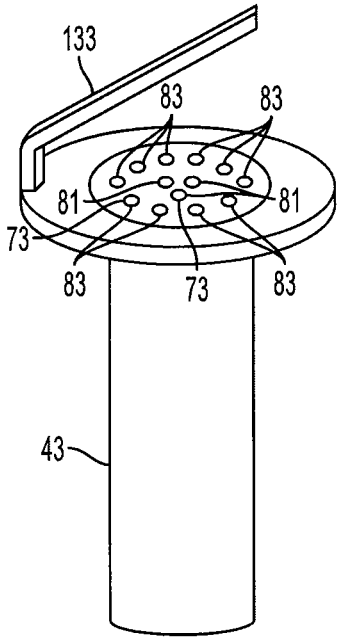
Figure 5C:
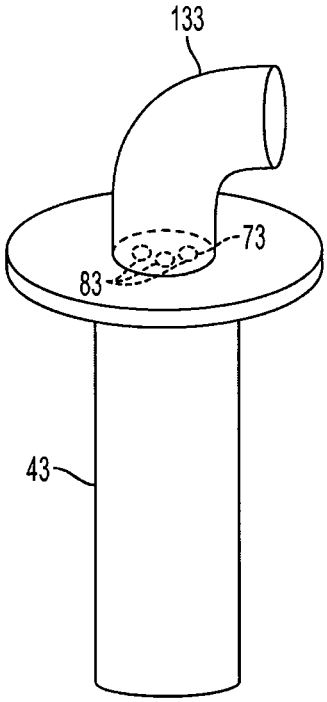
Figure 5D:
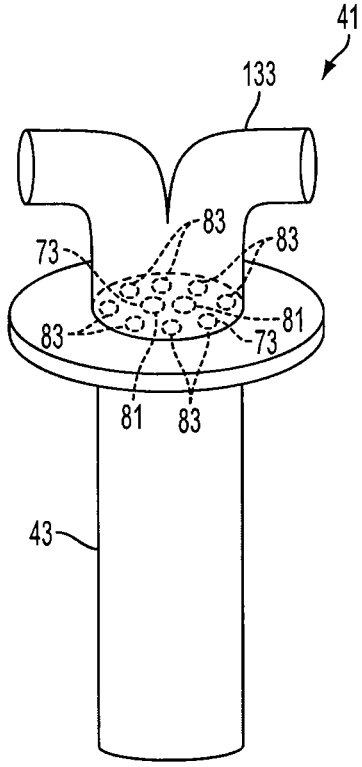

FIG. 5A illustrates an embodiment of the present invention including multiple water eruption jets 73 on a single support structure 43. It is contemplated that any number of water eruption jets 73 may be used to produce the water eruption effect, as desired. In addition, any number of water eruption effect support structures 43 may be positioned throughout the water play structure 40 to produce the water eruption effect, as desired. The support structure 43 may be used to angle or divert the plume of water in any direction as desired. In addition, the primary continuous-stream water fountains 81 and the secondary air-driven water jets 83 may be configured or angled to emit water in any direction. In one embodiment shown in FIG. 5B, a water diverter 133 may be used to deflect the plume of water emitted by the water jet 73 in a direction or multiple directions. In the embodiment shown in FIG. 5B, the water diverter 133 comprises a canopy structure designed to deflect the plume of water emitted by the water jet 73. Once the water is emitted by the water jet 73, the water falls in a direction towards the lower surface upon which the support structure 43 is positioned. It is also noted in FIGS. 5A and 5B, the number of primary continuous-stream water fountains 81 and the number of secondary air-driven water jets 83 has been varied from the embodiment shown in FIG. 5, as is contemplated by the present invention. FIG. 5C illustrates one embodiment of the present invention including a water diverter 133 having a curved tube-like shape. In this embodiment, the plume of water emitted by the water jet 73 will travel within the tube and will exit the tube in one direction. FIG. 5D illustrates an embodiment of the present invention including a water diverter 133 having a tube-like shape with multiple exit points. In this embodiment, the plume of water emitted by the water jet 73 will travel within the tube and will exit the tube in multiple directions. Yet still, once the water is emitted by the water jets 73, the water falls in a direction towards a lower surface upon which the support structure 43 is positioned. The water diverter 133 may be complementary or in lieu of a configuration of the support structure 43 designed to change the direction or spray characteristics of the plume of water emitted by the water jet 73. It is also noted in FIGS. 5C and 5D, the number of primary continuous-stream water fountains 81 and the number of secondary air-driven water jets 83 has been varied from the embodiment shown in FIG. 5, as is contemplated by the present invention. For example, the embodiment shown in FIG. 5C utilizes no primary continuous-stream water fountains 81.

Figure 6:
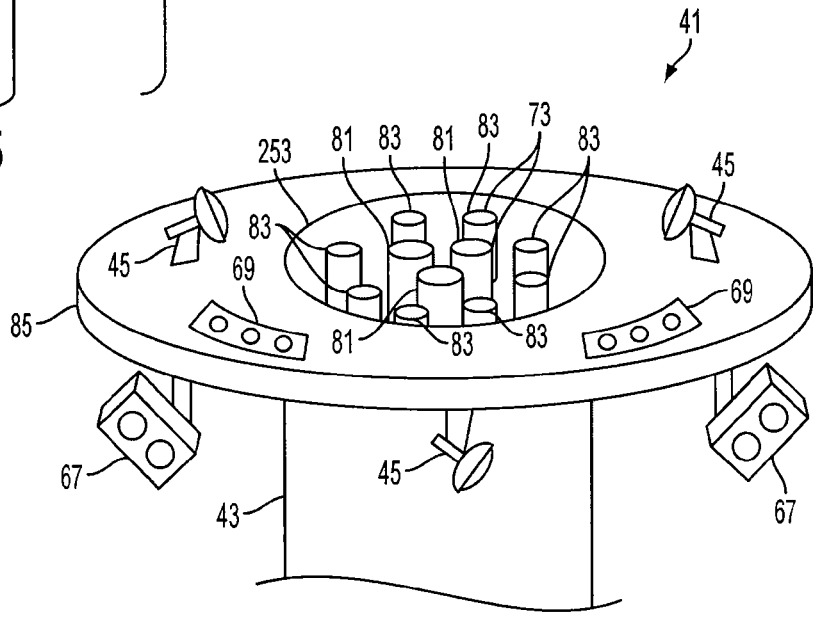
FIG. 6 illustrates a close-up perspective view of one embodiment of components of the water eruption effect device.
Figure 24:
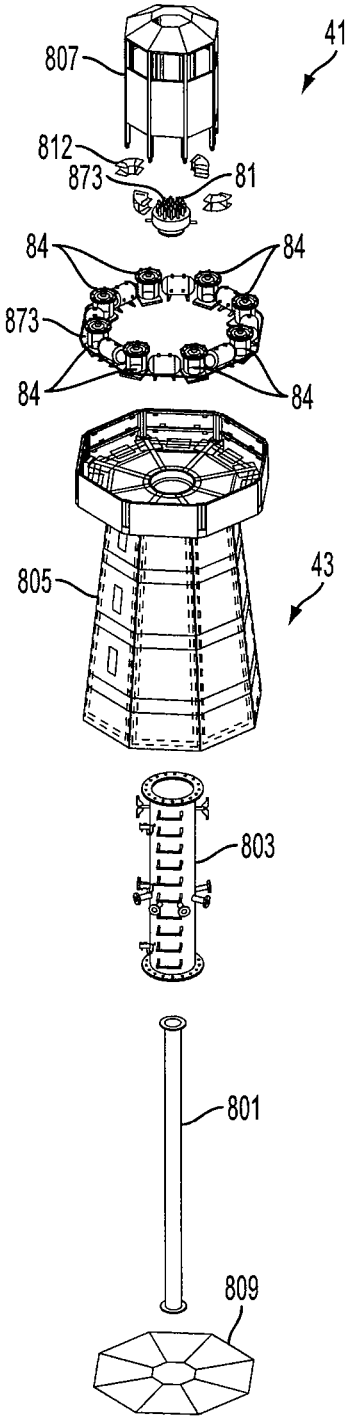
FIG. 24 is an expanded view of a water eruption effect device according to one embodiment of the present invention.
Figure 25:
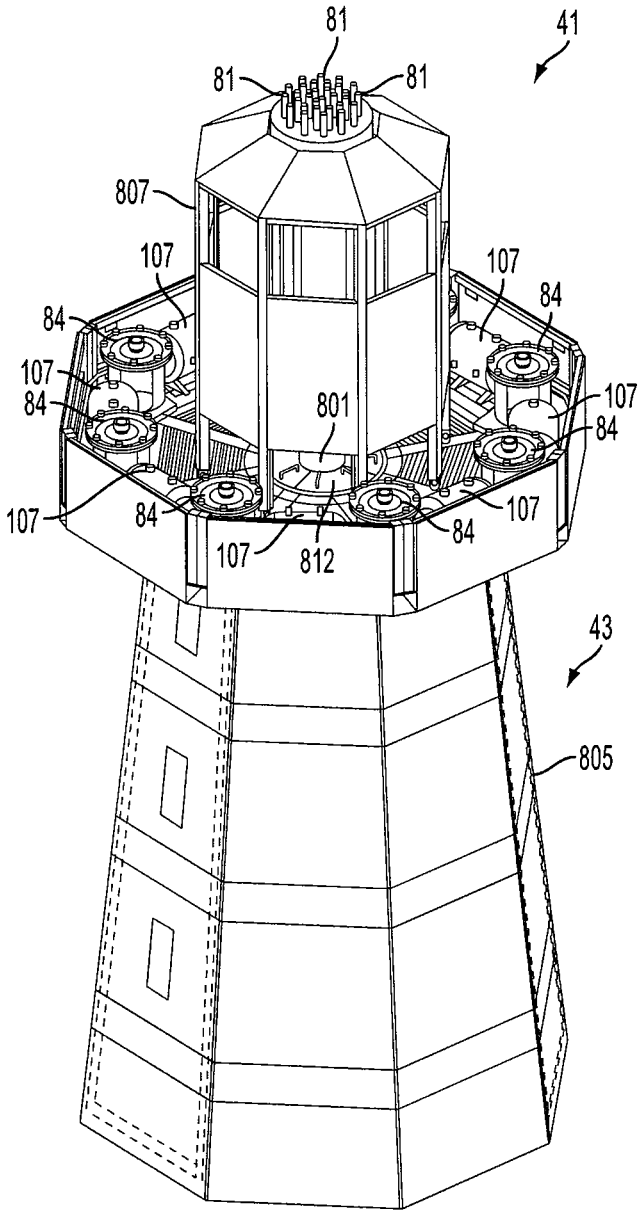
FIG. 25 is a perspective view of a water eruption effect device according to one embodiment of the present invention.

FIG. 6 illustrates a close-up perspective view of a water eruption jet 73 and the eruption effect device features 45, 67, 69, attached to the effect support 85. The primary continuous-stream water fountains 81 preferably have a nozzle diameter of about 6 inches, although this size may be varied without deviating from the scope of this invention. For example, in the embodiment shown in FIGS. 24 and 25, a primary continuous-stream water fountain 81 nozzle has a diameter of approximately 5/16 inches. At a nozzle diameter of about 6 inches, the primary continuous-stream water fountains 81 shown in FIG. 6 may emit a stream up to 30 to 40 feet high, or up to 80 to 90 total feet if the eruption effects support structure 43 is 50 feet high. The volume of water emitted by a single primary continuous-stream water fountain 81 with a 6 inch nozzle may be approximately 200 gallons per minute. Preferably, about three primary continuous-stream water fountains 81 comprise the water eruption jet 73, although this number may be varied without deviating from the scope of this invention. For example, FIGS. 24 and 25 illustrate a plurality (to the order of 40 fountains) of primary continuous-stream water fountains 81 capable of emitting between about 600 and 1400 gallons of water per minute in combination. If the water eruption jet 73 shown in FIG. 6 utilizes three primary continuous-stream water fountains 81, approximately 600 gallons per minute may be output in total. The position and spacing of each primary continuous-stream water fountain 81 may be varied without deviating from the scope of this invention. In one embodiment, a 24 inch diameter primary continuous-stream water fountain 81 may be used, comprising a series of smaller water nozzles, to give an overall larger appearance with less water.

The secondary air-driven water jets 83 have a nozzle diameter of approximately 1-4 inches, and are each capable of ejecting approximately 10 gallons of water to a height of approximately 50 feet into the air, or 100 feet if the eruption effects support structure 43 is 50 feet high. In the embodiment shown in FIG. 6, eight secondary air-driven water jets 83 surround the three primary continuous-stream water fountains 81, allowing approximately 80 gallons of water to be ejected at once. Preferably, about eight to twelve secondary air-driven water jets 73 are used, allowing approximately 80 to 120 gallons of water to be ejected at once. The numbers and size of secondary air-driven water jets 83 used and the capacity and ejection force of the water jets 83 may all be varied without deviating from the scope of this invention. For example, in the embodiment shown in FIGS. 24 and 25, secondary air-driven water jets 84 may each be capable of emitting as little as 40 gallons of water in combination at once. In one embodiment, a single 100 gallon secondary air-driven water jet 83 could be used, alone or in combination with other air-driven water jets 83. In one embodiment, multiple 100 gallon secondary air-driven water jet 83 could be used, alone or in combination with other air-driven water jets 83.

The primary continuous-stream water fountains 81 and the secondary air-driven water jets 83 may be positioned within a pool 253, which is capable of being filled with water (not shown). The nozzles of the secondary air-driven water jets 83 may be positioned submerged, below the surface of the water filling the pool 253. The water filling the pool 253 is pumped up to the position of the water eruption jet 73 with a standard pump system (not shown). The standard pump system may draw water from the return conduits 118 shown in FIG. 2, or may derive water from a separate source.

The position of the nozzles, below the surface of the water, allows reservoirs 103, described in relation to FIG. 8, to fill with water from the pool 253. After each reservoir 103 is full, overflow water may run off the top of the effect support 85. Air is blown through the filled reservoirs 103 to eject the water. Once the water is ejected from the reservoirs 103, water from the pool 253 again pours into the submerged reservoirs 103, to refill the reservoirs 103 in preparation for another water ejection.

Figure 7:
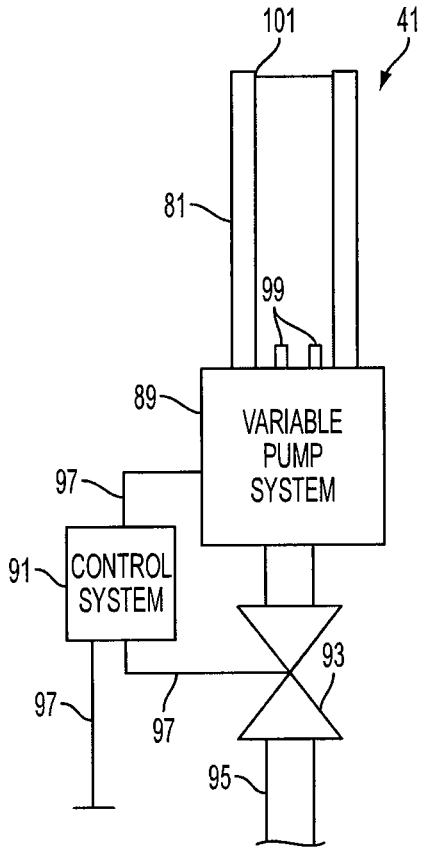
FIG. 7 illustrates a side schematic view of a primary continuous-stream water fountain according to one embodiment of the present invention.

FIG. 7 illustrates a side schematic view of the primary continuous-stream water fountain 81. The primary continuous-stream water fountain 81 includes a variable pump system 89, a nozzle 101, a variable pump system 89, a primary fountain control system 91, a valve 93, a primary fountain water conduit 95, connection lines 97, and primary fountain lighting devices 99. The variable pump system 89 comprises a general pump system capable of producing a variable pressure stream of water. The pump system receives water from the primary fountain water conduit 95, and ejects the water through the primary fountain nozzle 101. It is noted the variable pump system 89 will be capable of high-power operation, especially if water is pumped through the nozzle 101 from the top of the support structure 43 50 feet in height. The primary fountain water conduit 95 may be a component of the return conduit 118 system shown in FIG. 2, or may receive water from a different source.

The flow through the primary continuous-stream water fountain 81 may be controlled electrically by the primary fountain control system 91, which connects to the variable pump system 89 via connection lines 97, and controls a valve 93 controlling flow to the variable pump system 89. The pump system 89 pressurizes the water that flows through the nozzle 101. The primary fountain control system 91 provides signals that control the output of the variable pump system 89 (e.g., pressure amount). The primary fountain control system 91 may be integral with the electrical control system 75 shown in FIG. 3, or may be a separate component. In one embodiment, the variable pump system 89 may be not be utilized, but rather the valve 93 may be a variable control valve that varies the rate of water flow that passes through the nozzle 101. The water passing through the nozzle 101 may be pressurized at a remote location (for example the pump system 114 shown in FIG. 2) and the primary fountain control system 91 may serve to vary the flow rate through the nozzle 101 by varying the flow through the valve 93.

The primary fountain control system 91 may be programmed to produce variable effects simulating an eruption, or an overflow (e.g., a lava flow or wave flow) as described in relation to FIG. 1. In addition, primary fountain control system 91 may control primary fountain lighting devices 99, which may comprise standard LED or incandescent lighting devices capable of illuminating a stream of water emitted from the nozzle 101.

Figure 8:
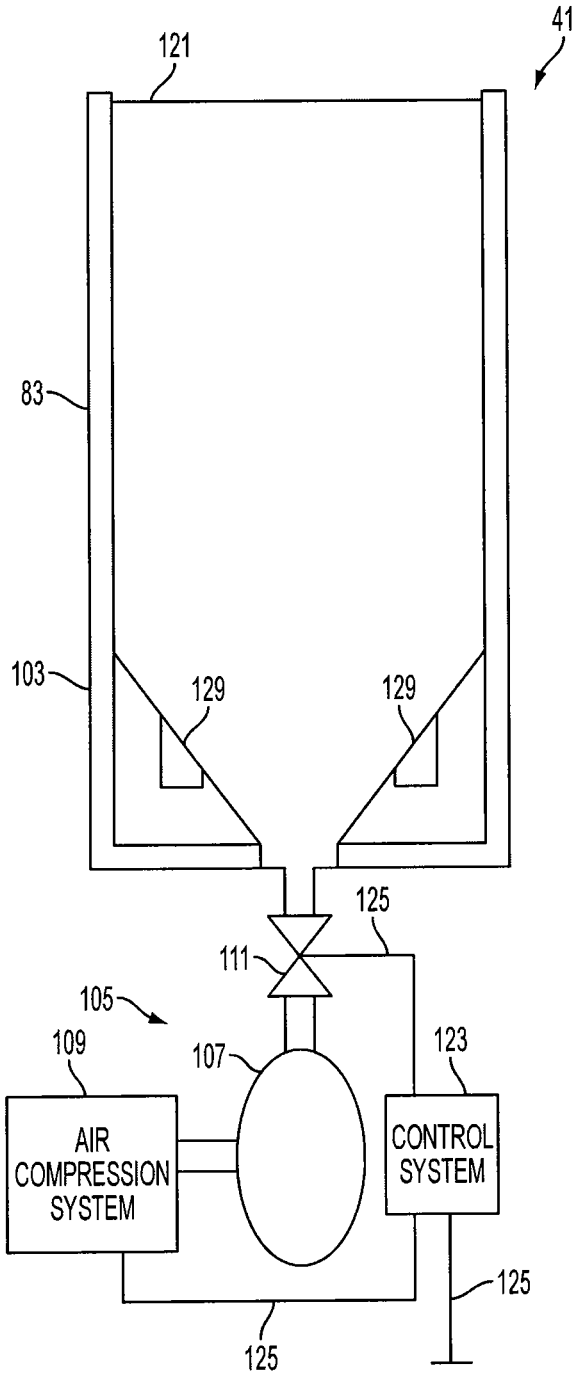
FIG. 8 illustrates a side schematic view of a secondary air-driven water jet according to one embodiment of the present invention.

FIG. 8 illustrates a schematic side view of the secondary air-driven water jet 83. The secondary air-driven water jet 83 includes a reservoir 103, and an ejection system 105 comprising an air canister 107, an air compression system 109, and an air solenoid valve 111. Other components of the secondary air-driven water jet 83 include a secondary jet control system 123, connection lines 125, a secondary jet nozzle 121, and secondary jet lighting devices 129. The reservoir 103 comprises a container capable of holding a large quantity of water, to the order of 10 gallons, although this amount may be varied without deviating from the scope of this invention. For example, the secondary air-powered water jets 84 shown in FIGS. 24 and 25 may each only be capable of holding about 5 gallons. The reservoir 103 has a nozzle 121 at one end, serving as an exit point for the water in the reservoir 103. The nozzle 121 is submerged below the surface of water filling the pool 253, as described in relation to FIG. 6. The reservoir 103 is filled with water pouring in from the pool 253 into the nozzle 121.

Once the reservoir 103 is filled with water, the ejection system 105 provides a blast of air that passes through the filled reservoir 103 and blows the water out the nozzle 121. The ejection system 105 may be integrated with multiple reservoirs 103, to eject water, for example, at shortened refill cycles. The ejection system 105 includes an air canister 107 that retains a volume of compressed air. The air canister 107 is filled via the air compression system 109, which comprises a standard air compressor. When the air canister 107 is filled to the desired air pressure, air solenoid valve 111 opens, which releases the compressed air through the reservoir 103. The valve 111, by being capable of opening and closing, controls the flow of pressurized air through the reservoir 103. The air solenoid valve 111 prevents water from exiting the lower end of the reservoir 103. The air solenoid valve 111 may also be exchanged with a different, equivalent style of valve, without deviating from the scope of this invention. The compressed air force the water out the nozzle 121, creating a large geyser-like explosive water plume until the water in the reservoir 103 runs out. During operation, the water and air mix as the water shoots out of the nozzle 121, further dispersing the water. By varying the size of the nozzle 121 and the amount of compressed air used, a smaller eruption on the order of 10 feet, or a larger eruption up to over 100 feet in height may also be produced.

Operation of the solenoid air valve 111 and air compression system 109 may be controlled by secondary jet control system 123. Secondary jet control system 123 connects to the secondary jet components via connection lines 125, and coordinates the timing of the ejection system 105. The secondary jet control system 123 may be integral with the electrical control system shown in FIG. 3, or may be a separate component. The secondary jet control system 123 may be programmable to produce the effect of an eruption, as discussed in relation to FIG. 1. In addition, secondary jet control system 123 may be used to operate secondary jet lighting devices 129, which comprise standard LED or incandescent lights capable of illuminating the burst of water emitted from nozzle 121.

Figure 9A:
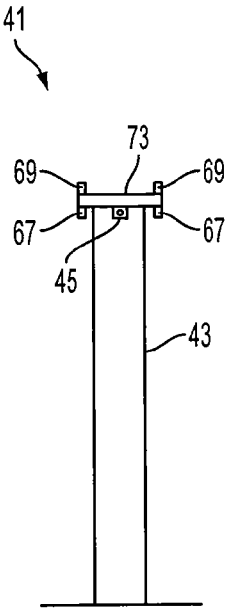
FIG. 9A-9D illustrate side views of an eruption sequence according to one embodiment of the present invention.
Figure 9B:
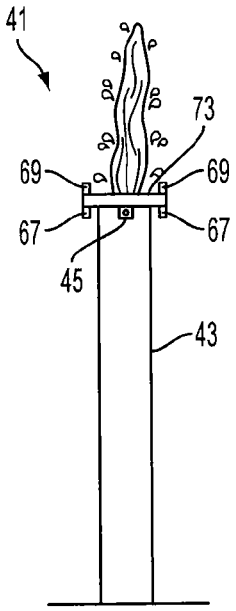
Figure 9C:
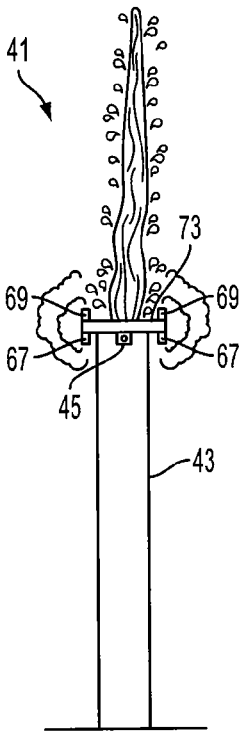

FIGS. 9A-9D illustrate the sequence of events performed by the water eruption effect device 41 to produce the eruption effect described in relation to FIG. 1. FIG. 9A illustrate the initial state, when the water eruption jet 73 is not emitting water and the associated devices 45, 67, 69 are not producing an eruption effect. As discussed in relation to FIG. 1, this initial state may last for a determined time, as desired. The duration may last for approximately 8 minutes, or the amount may vary at random intervals or predetermined intervals. FIG. 9B illustrates the initiation of the second phase of the eruption effect, when the water eruption jet 73 starts to emit water, and the associated devices 45, 67, 69 start to produce signs of a coming eruption. These signs may be random or progressive, or a combination of both, as discussed in relation to FIG. 1. At this stage, only the primary continuous-stream water fountains 81, shown in FIGS. 5, 6, and 7 are operating, and not the secondary air-driven water jets 83. The stream emitted by the primary continuous-stream water fountains 81 may be gradually increasing in height as time passes, raising to approximately 30 to 40 feet in height above the top of the eruption effect structure 43, as shown in FIG. 9C.

FIG. 9C illustrates the height of the primary fountain stream after it has gradually reached a height of 30 to 40 feet above the top of the eruption effect structure 43. At this point, the lighting devices 45, and the sound devices 67 continue to indicate a coming eruption. A layer of smoke or mist may surround the water eruption jet 73. The other eruption effects 45, 65, 67, 69, and 71, not connected to the support structure 43, and shown in FIG. 1, also indicate an eruption is about to occur. For example, prior to the eruption of the secondary air-driven water jet 83, or the primary continuous-stream water fountain 81 (in an embodiment in which the continuous-stream water fountains 81 serve as the eruption effect) a signal may sound, through a sound speaker, or sound device 67, or a lighting device 45, that the eruption will occur within at least a span of a minute, from the time the signal sounds.

Figure 9D:
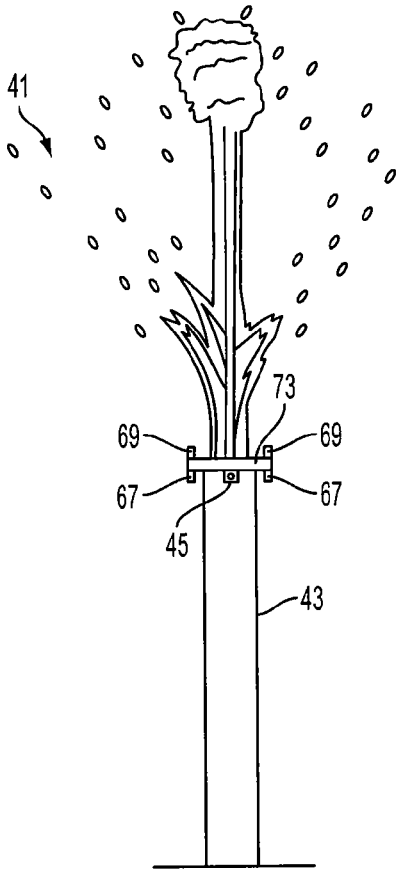

The period shown in FIGS. 9B and 9C may last approximately 2 minutes, and culminate in the eruption shown in FIG. 9D. FIG. 9D illustrates the eruption, when the secondary air-driven water jets 83 release the large quantity of water stored in the jets' reservoir 103 (shown in FIG. 8) into the air at once. The eruption may be accompanied by associated eruption effects produced by the associated eruption devices 45, 65, 67, 69, 71 (e.g., flashing lights, loud sounds). The eruption may last for approximately 1 to 2 minutes, including a series of eruptions from the secondary air-driven water jets 83. After the eruption, the water eruption effect device 41 returns to the state shown in FIG. 9A.

As discussed in relation to FIG. 1, the entire cycle shown in FIGS. 9A-9D may last approximately 10 minutes, although this time may be changed without deviating from the scope of this invention. The timing of any phase or the number of phases of the eruption sequence may also be changed without deviating from the scope of this invention.

Figure 10:
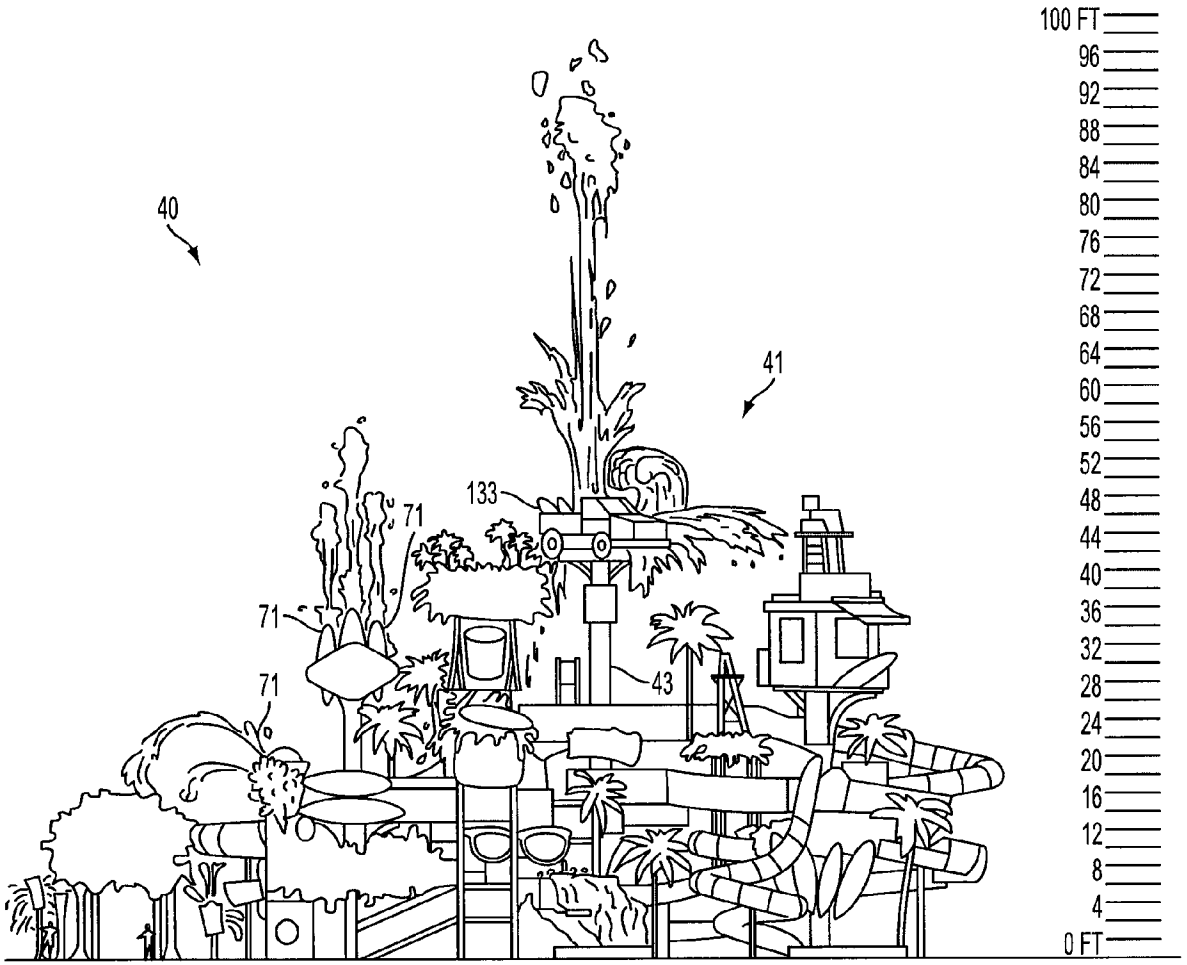
FIG. 10 illustrates a front perspective view of a participatory water play system having features of the present invention.

FIG. 10 illustrates a configuration of the water eruption effect device 41, implemented in a surfing or beach theme. The eruption effect support structure 43 is shown in a central position within the water play structure 40 and towers above the other components in the water play structure 40. Fountain devices 71 are positioned on tower structures, and emit streams of water. A water diverter 133 is also shown deflecting a portion of the eruption water in a direction towards the horizon. In the embodiment shown in FIG. 10, the water diverter 133 comprises an ornamental element, namely a car positioned on top of the eruption effect support structure 43 and emitting water from the front of the car.

Figure 11:
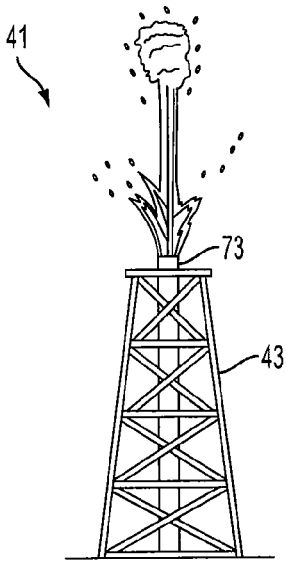
FIGS. 11-14, and FIG. 14A illustrate side views of components of the water eruption effect device according to embodiments of the present invention.
Figure 12:
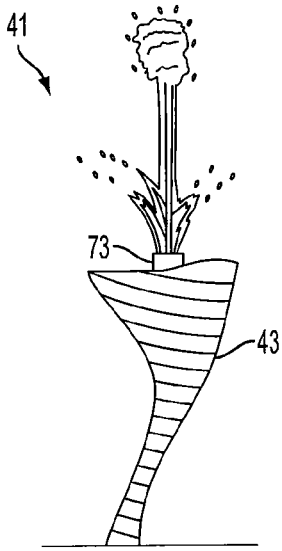
Figure 13:
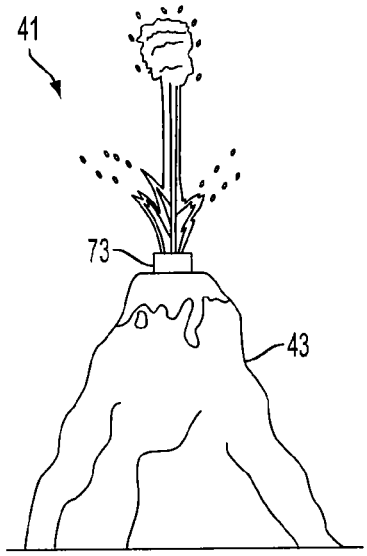
Figure 14:
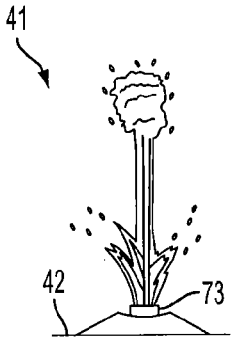
Figure 14A:
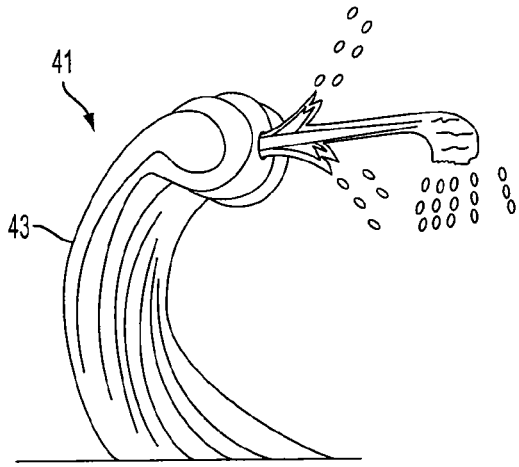

FIGS. 11-14, and 14A illustrate other theme embodiments of the water eruption effect device 41. FIG. 11 illustrates a columnar structure, themed as an oil derrick, for the water eruption effect device 41. FIG. 12 illustrates columnar structure, themed as a water spout, for the water eruption effect device 41. FIG. 13 illustrates columnar structure, themed as a volcano or mountain, for the water eruption effect device 41. FIG. 14 illustrates a thermal geyser theme for the water eruption effect device 41. It is noted the configuration shown in FIG. 14 includes an eruption effect support structure 43 (not shown) positioned beneath the ground, as the water eruption jet 73 is positioned at, or slightly elevated from the ground level 42 of the water play structure 40. The water eruption effect device 41 needs to only include a single secondary air-driven water jet 83 to produce the eruption effect, as a series of blasts of water from the water jet 83 would produce a form of eruption. However, this eruption effect may be enhanced by the additional eruption devices discussed throughout this application. FIG. 14A illustrates a columnar structure themed as water wave for the water eruption effect device 41. In this embodiment, the water plume is ejected in a direction towards the horizon. A water diverter 133 described in relation to FIGS. 5B-5D may be used to produce the stream of water emitted towards the horizon.

Figure 15:
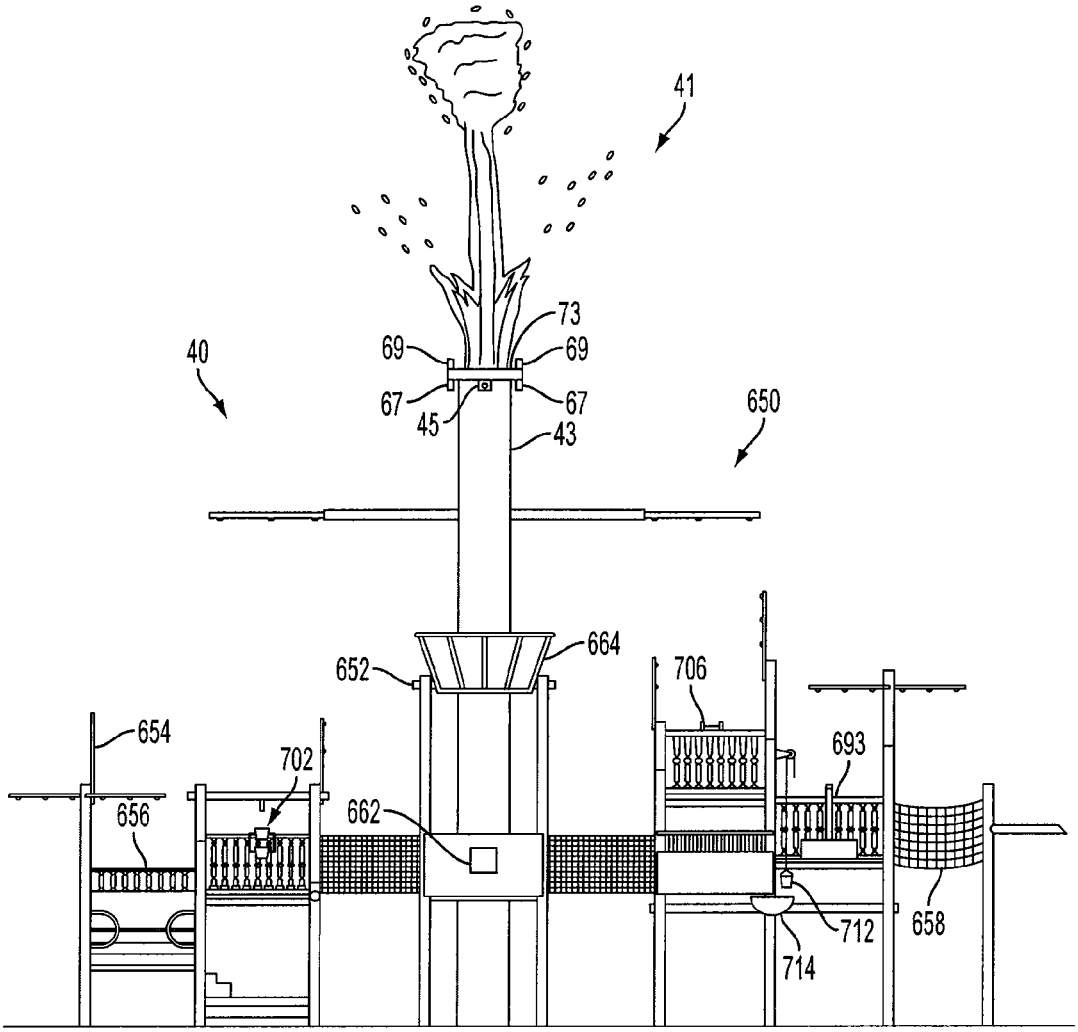
FIG. 15 illustrates a front elevational view of a participatory water play system according to one embodiment of the present invention.

FIG. 15 illustrates the water eruption effect device 41 configured in a pirate ship theme. The water eruption effect support structure 43 is positioned centrally within the water play structure 40. The water eruption effect device 41 has a columnar structure, shaped as a tower, which extends upwards from a lower surface of the water play structure 40. In this configuration, the water play structure 40 is a multi-level structure 650 including play and theme elements such as ship's masts 654, spindle-style railings 656, tipping buckets 702, support framework 652, a crow's nest 664, cannon portholes 662, tipping trays 706, basins 714, buckets 712, pump guns 693, and bridges 658.

FIG. 16 illustrates a water effect device comprising light towers 65 that may form a component of the water eruption effect device 41. The light towers 65 comprise columnar structures that emit light from the interior of the light tower 65. The columnar structure has a lower end configured to rest on a lower surface and an upper end extending upward from the lower surface. In addition, streaming water flows down the exterior of the column, allowing the light to pass through the outer surface of the body of the column and produce a shimmering lighted fluid effect. The color and intensity of the emitted light may vary, and the flow rate of the water may vary during the eruption effect described in relation to FIG. 1 and FIGS. 9A-9D. However, it is also contemplated the light tower 65 may not comprise a component of the water eruption effect device 41, and may serve as a stand-alone feature. In other words, the light towers 65 may be used in a water play structure without a water eruption effect device, may be used in a water play structure with a water eruption effect device 41 and not be associated with the device 41, or may not be part of a water play structure entirely. It is also contemplated an eruption effect device 41 may be placed within the interior of a light tower 65 as a stand-alone effect. Although FIG. 16 illustrates the light towers as cylinders, the light towers 65 may also be shaped to have various shapes (e.g., may have a polygonal shape, or may comprise dome-like shapes, or could mimic trees or fans, or the like), as desired, without deviating from the scope of this invention.

FIG. 17 illustrates an exploded view of the light tower 65, displaying the component parts including a support column 201, a cap 203, a body or shell 205, a lower plate 207, an upper plate 209, light tower lighting devices 211, and shell retainers 213. The support column 201 comprises a rigid mast structure that provides a central support for the light tower 65. A light tower fluid conduit 215 may pass through the center of the support column 201, as shown in FIG. 18. A cap 203 is positioned at one end of the support column 201 and defines the upper limit of the light tower 65. The light tower 65, including the cap 203, may extend to a height of between 10 and 50 feet, although this height may be varied without deviating from the scope of this invention.

The support column 201 also supports the body or shell 205, connected to the support column via the shell retainers 213. The body or shell 205 defines the outer surface of the light tower 65 that water flows over during operation. The shell 205 may be composed from a plurality of rigid curved half-pipes, preferably made of a material that permits visible light to pass therethrough, including a translucent fiberglass material, or other equivalent translucent materials. The preferred translucent fiberglass provides support for the exterior surface of the light tower 65, but also allows light emitted from the interior of the light tower 65 to be visible from the outside of the light tower 65, through the flowing water. The shell 205 may also be made of a colored translucent fiberglass material. The shell 205 may have various other shapes (e.g., a polygonal, a dome-like shape, a tree-like shape, or the like) depending on the desired structure of the light tower 65, without deviating from the scope of this invention.

The lighting devices 211 may comprise standard LED or incandescent lights capable of changing colors, intensity, or blinking frequency. The lighting devices 211 may be positioned along the support column 201, or on the shell retainers 213, or on the interior or exterior of the shell 205. Generally, the lighting devices 211 are positioned and configured to produce light visible through the outer surface of the shell 205 and through the sheet of water flowing over the exterior of the shell 205.

The upper end of the columnar structure is structured to direct fluid delivered from the fluid conduit to stream down the outer surface of the body towards the lower surface. Namely, the lower plate 207 and upper plate 209 are configured to support the cap 203 and also to divert water from the interior of the shell 205 to the exterior surface of the shell 205. FIG. 18 illustrates a side schematic view of the light tower 65, showing a configuration of the light tower fluid conduit 215, the lower plate 207, and the upper plate 209. The light tower fluid conduit 215 flows water pressurized by the pump 217 up through the interior of the support column 201. The pump 217 and fluid conduit 215 may comprise part of the return conduit 118 and pump system 114 shown in FIG. 2, or may comprise a separate system. Once the water travels up the fluid conduit 215, it travels along the top of the lower plate 207, and through a channel 219 formed between top plate 209 and lower plate 207. The channel 219 allows the water to extend down and flow over the outer surface of the shell 205. The operation of the pump 217 and lighting devices 211 may be controlled by the electrical control system 75 shown in FIG. 3, or by a separate control system.

Figure 19:
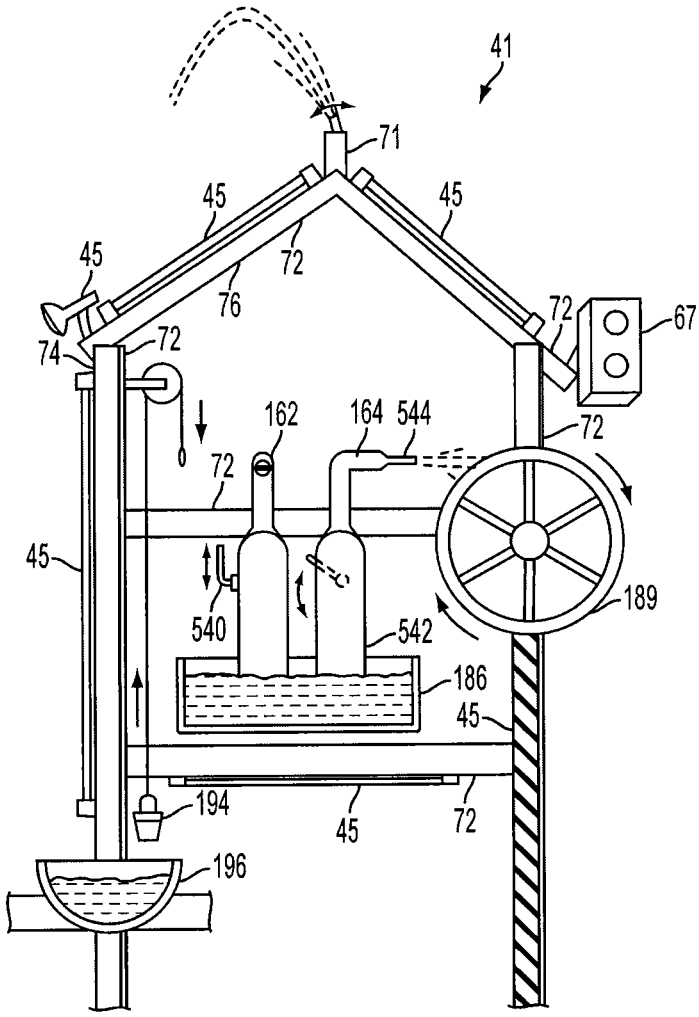
FIG. 19 is a front elevational view of the supporting framework of the water play structure according to one embodiment of the present invention.

FIG. 19 illustrates components of the water eruption effect device 41 including lighting devices 45, sound devices 67 and fountain devices 71, positioned on the supporting framework 72, including the water carrying conduits 74 and the non-water carrying conduits 76 of the water play structure 40, shown, for example, in FIG. 1. In the embodiment shown in FIG. 19, the particular framework houses water play elements including rope and pulley operated buckets 194, a lower basin 196, a pump basin 186, pump guns 162, 164, a pump gun housing 542, a hand activated lever 540, a water wheel nozzle 544, and water wheel 189. However, the eruption effect components 45, 67, 71 may be positioned on any of the framework 72 associated with the water play structure 41.

The lighting devices 45 may include LED lights or incandescent lights placed on the framework 72. It is also contemplated a lighting effect may be produced through fluorescent paint covering the framework 72. The lighting devices 45 may be positioned in tubes or flexible coils wrapped around, or embedded into the framework 72. The lighting devices 45 may also be built directly into the water play structure framework 72. The lighting devices 45 may be able to change color, intensity and blinking frequency. In addition, the sound devices 67 may be mounted directly to the framework 72. The fountain devices 71 may also be mounted to the framework 72 and may be capable of emitting a stream of water that can vary in direction, flow pressure, and internal lighting characteristics.

Figure 20:
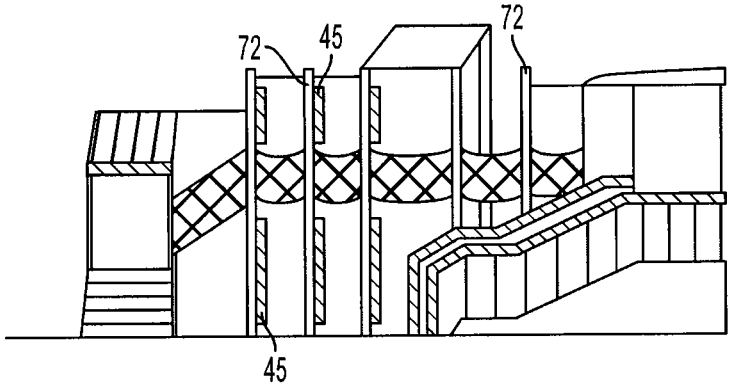
FIG. 20 is a perspective view of a water play structure according to one embodiment of the present invention.

The lighting devices 45, sound devices 67 and fountain devices 71 may also be used separately from the water eruption effect device 41. Thus, these devices 45, 67, 71 may be used in a water play structure without any eruption effect. FIG. 20 illustrates an embodiment of the present invention without a water eruption effect device 41. Lighting devices 45 in the form of lighted cords are positioned on the supporting framework 72 of the water play structure 40. Whether used for an eruption effect or not, these devices 45, 67, 71 may be controlled electrically by the electrical control system 75 shown in FIG. 3, or by a separate control system.

Referring back to FIG. 1, the lighting devices 45, the light towers 65, the sound devices 67, the mist or smoke devices 69, the fountain devices 71 and the water eruption jet 73 may all be used to perform a water and light show at night. The show may resemble a water eruption, and may use all of the components of the water eruption effect device 41. In addition, the show may be a general water and light show, using any of the described lighting devices 45, sound devices 67, or light towers 65. The show may also include a dancing fountain show, using the water eruption jet 73 and the fountain devices 71 shown in FIG. 19. A combination of all these effects in multiple variations may be used to produce a show. The show is designed to attract customers and increase use of the park during the night-time and in the off-season.

Figure 21:
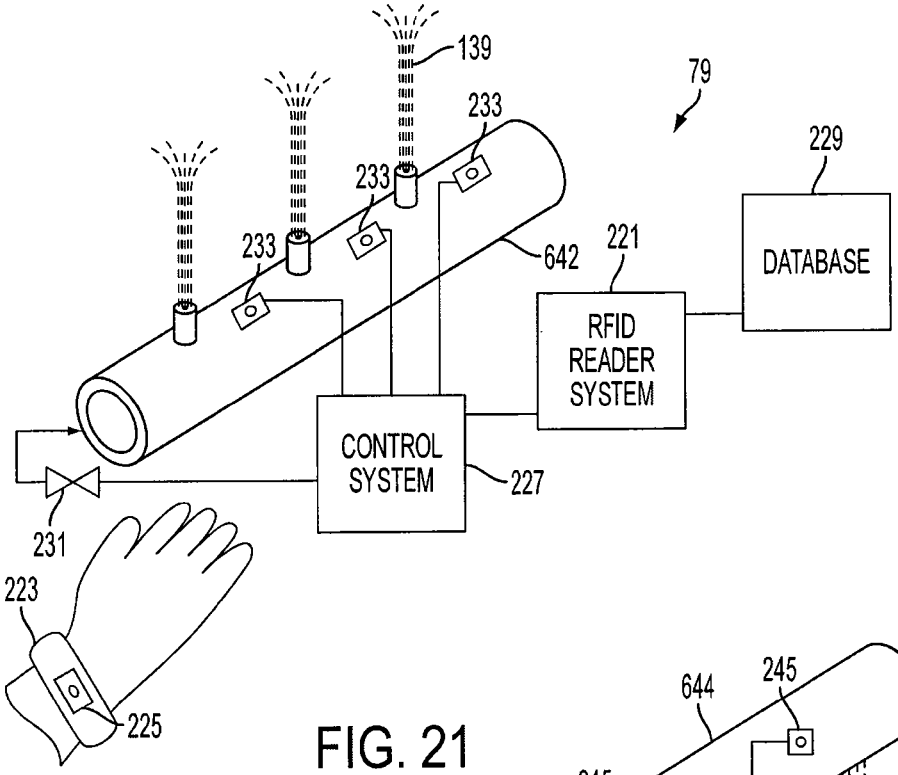
FIG. 21-23 are schematic views of responsive water play devices according to embodiments of the present invention.

FIG. 21 illustrates a schematic view of a responsive water play device 79 utilizing a Radio-Frequency Identification (RFID) system. Components of the responsive water play device 79 include an RFID reader system 221, an RFID tag 225, and RFID tag holder 223, an RFID control system 227, a database 229, a valve 231, RFID activated lights 233, and a horizontal pipe 642. The horizontal pipe 642 represents any component of the water carrying conduits 74 of the water play structure 40. The RFID reader system 221 comprises a general purpose RFID reader device capable of detecting and reading information produced by an RFID tag. The RFID reader system 221 may be positioned on or near the water carrying conduits 74, or generally on the supporting framework 72 of the water play structure 40 shown in FIG. 1.

In the embodiment shown in FIG. 21, the RFID tag 225 is held by an RFID holder 223, which may comprise a bracelet wrapped around a play participant's wrist, or any other equivalent device (e.g, a wand, or the like). The RFID tag 225 may be associated with some form of identifying information selected or provided by the play participant. For example, the play participant may provide information about the participant's gender to a distributor of the RFID tag 225, or to an automated kiosk. The database 229, which may be positioned remotely or near the RFID reader system 221 may be updated to indicate the RFID tag 225 is associated with, for example, a male play participant. When the RFID reader system 221 detects the RFID tag 225 passing nearby, the database 229 is accessed to determine the updated characteristic, for instance, the participant's gender. The identified information is delivered to RFID control system 227, which may be integral with the electrical control system 75 shown in FIG. 3, or may be a separate component. The RFID control system 227 may activate valve 231, which allows water to flow through horizontal pipe 642, producing spray jets 139. The RFID control system 227 may also activate RFID activated lights 263. Because the RFIG tag 225, in this example, indicated the play participant was male, the RFID activated lights 263 may flash with a blue light. If the RFID tag 225 indicated a female play participant, the RFID activated lights 263 may flash pink lights. Thus, the RFID reader system 221 allows the play structure 40 to interact and respond to the play participants by identifying a play participant's presence, and by responding to the personal characteristics selected or presented by the play participant.

The above described example illustrates only one use of the RFID system. Other uses include a database 229 that maintains a log of the times an RFID reader system 221 detects a certain RFID tag 225 at multiple locations in the water play structure 40. For example, if a play participant activates five series of RFID activated lights 263, the database 229 can track this activity and may award the participant with a prize. In addition, the play participant may select a character type that elicits a certain response from the RFID control system 227. For example, a play participant may select a character that never gets wet, always gets wet, or almost gets wet. This information may be stored and retrieved from the database 229 to determine a corresponding force or direction of flow of the spray jets 139, for example. In addition, the RFID activated lights 263 may be placed in a pattern that displays a different design based on a gender or character selected by the play participant (e.g., a gorilla may be displayed for a boy, and a princess may be displayed for a girl). The database 229 can log and maintain a list of a play participant's activity over a single visit to the park or over repeated visits.

The extent of the RFID control system's 227 control is not limited to spray jets 139 and RFID activated lights 237, but rather the RFID control system 227 may control any of the lighting devices 45, light towers 65, sound devices 67, mist or smoke devices 69, fountain devices 71, and the water eruption jet 73. Any component of the water eruption jets 73, 873 discussed throughout this application may be activated upon an RFID sensor, or RFID reader system 221 detecting an RFID signal. In addition, the database 229 may be used to track activities of play participants that initiate the water eruption effect. For example, the water eruption effect device 41 may only become activated after a play participant, or a group of play participants engages in a series of recorded actions. The RFID control system 227 may also control any of the water play or non-water play devices positioned throughout the water play structure. The RFID system is designed to increase the total interactivity of the water play structure 40.

Figure 22:
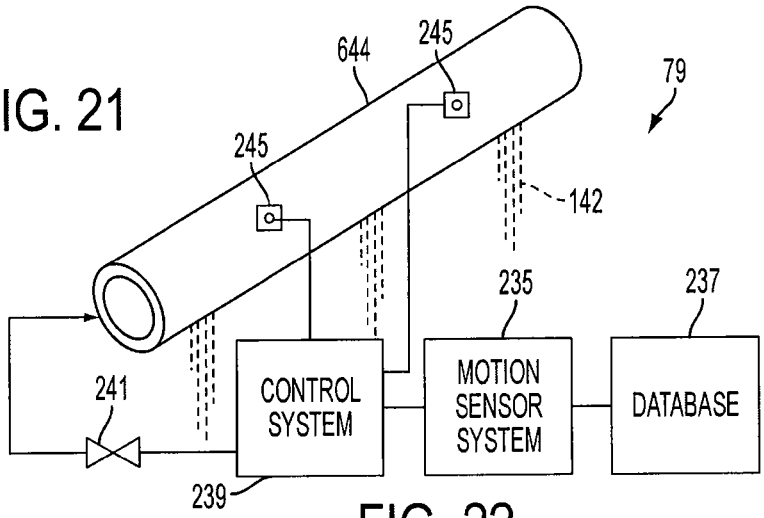

FIG. 22 illustrates a schematic view of a water play device 79 utilizing a motion sensor mechanism. Components of the responsive water play device 79 include a motion sensor system 235, a motion sensor control system 239, a database 237, a valve 241, motion sensor activated lights 245, and a horizontal pipe 644. The horizontal pipe 644 represents any component of the water carrying conduits 74 of the water play structure 40. The motion sensor system 235 comprises a general purpose motion sensor system, namely an infrared detection system. The RFID reader may be positioned on or near the water carrying conduits 74, or generally on the supporting framework 72 of the water play structure 40 shown in FIG. 1.

The motion sensor system 235 may detect the motion or presence of a nearby play participant, and may instruct the motion sensor control system 239 to activate the valve 241, producing shower spray 142. The motion sensor control system 239 may also activate the motion activated lights 245 when the participant is nearby. The motion sensor system 235 may also maintain a list in the database 237 of the number of play participants that have activated the motion sensor system 235. After a certain number of play participants have passed, a specified event, such as the initiation of the water eruption effect device 41, may occur. The motion sensor control system 239 may be integral with the electrical control system 75 shown in FIG. 3, or may be a separate component.

The extent of the motion sensor control system's 239 control is not limited to shower spray 142 and motion activated lights 245, but rather the motion sensor control system 239 may control any of the lighting devices 45, light towers 65, sound devices 67, mist or smoke devices 69, fountain devices 71, and the water eruption jet 73. Any component of the water eruption jets 73, 873 discussed throughout this application may be activated upon a motion sensor, the motion sensor system 235 detecting motion. The motion sensor control system 239 may also control any of the water play or non-water play devices positioned throughout the water play structure. The motion sensor system is designed to increase the total interactivity of the water play structure 40.

Figure 23:
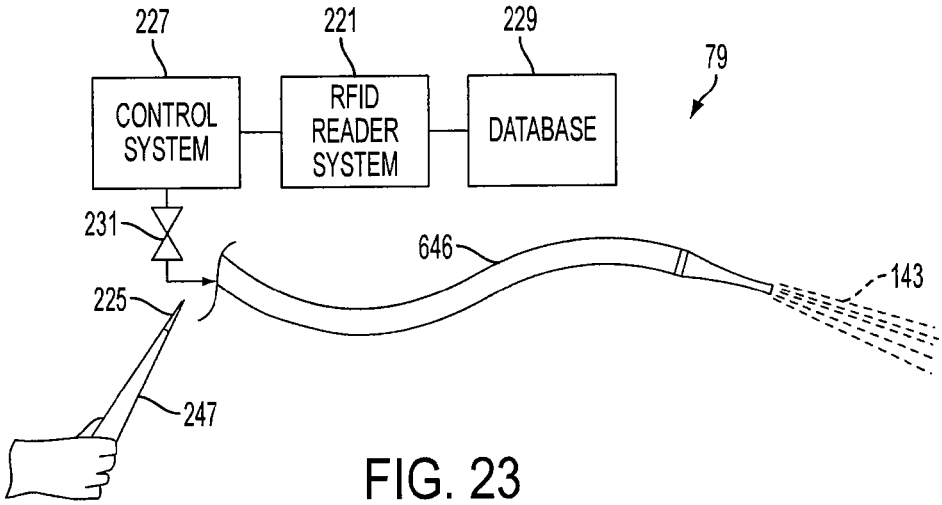

FIG. 23 illustrates an embodiment of the RFID system shown in FIG. 21, wherein the RFID tag holder 223 in the form of a bracelet is replaced by an RFID tag holder 247 in the form of a wand. In this embodiment, the play participant may carry a wand that can activate any of the devices described in this application. In the embodiment shown in FIG. 23, the play participant may activate an attack hose 646 used to soak another play participant with a spray 143.

FIG. 24 illustrates an embodiment of a water eruption device 41 including a water eruption jet 873 with plurality of secondary air-driven water jets 84 positioned circumferentially around plurality of primary continuous stream water fountains 81. The primary continuous stream water fountains 81 and secondary air-driven water jets 84 are positioned on a water eruption effect support structure 43 made of a series of components, including a fluid conduit 801, a central mast, or support 803, a lower housing 805 and an upper housing 807. The water eruption effect support structure 43 additionally includes a lower net 809 and plates 812. FIG. 24 represents an assembly view of the support structure 43 and the primary continuous stream water fountains 81 and secondary air-driven water jets 84.

FIG. 25 illustrates a perspective view of the assembled water eruption effect support structure 43 and primary continuous stream water fountains 81 and secondary air-driven water jets 84 of FIG. 24. The support structure 43 is shown to have a substantially columnar shape, particularly configured in the shape of a tower and themed as a lighthouse. A lower end of the support structure 43 is configured to rest on a lower surface, such as the ground, or an elevated platform. The upper end of the water eruption effect support structure 43 includes the plurality of primary continuous stream water fountains 81 and secondary air-driven water jets 84 coupled thereto. The primary continuous stream water fountains 81 are positioned at a greater height from the lower end of the water eruption effect support structure 43 than the secondary air-driven water jets 84. The primary continuous stream water fountains 81 are positioned at the top of the support structure 43, on top of the upper housing 807. When the support structure 43 is assembled, the fluid conduit 801 passes through the central support 803 and the lower housing 805, to supply water to the primary continuous stream water fountains 81 at the top of the water eruption effect support structure 43. The plates 812 secure the fluid conduit 801 to the lower housing 805. Although not visible in FIG. 25, the central support 803 is positioned within the lower housing 805 and provides support for the water eruption effect support structure 43. In addition, although not visible in FIG. 25, the lower net 809 prevents individuals from entering the interior of the lower housing 805 from below. The primary continuous stream water fountains 81 and secondary air-driven water jets 84 shown in FIGS. 24 and 25 comprise the equivalent of the water eruption jet 73 discussed, for example, in relation to FIG. 1.

The primary continuous stream water fountains 81 shown in FIGS. 24 and 25 include a plurality of nozzles, positioned adjacent to each other to form one large primary continuous stream water fountain 81 nozzle. Each primary continuous stream water fountain 81 is configured similarly as the primary continuous stream water fountain 81 shown and described in relation to FIG. 7. Similar to the embodiment shown in FIG. 7, a pump, or variable pump system 89 may be located remotely from the nozzle 101, and may cause variably pressurized fluid to travel up the fluid conduit 801. In addition, in one embodiment, the variable pump system 89 may be positioned near the primary continuous stream water fountains 81 shown in FIG. 25, and may draw fluid up the fluid conduit 801.

In the embodiment shown in FIG. 25, approximately 40 primary continuous stream water fountains 81 nozzles are utilized to produce a large primary continuous stream water fountain 81, although this number may be varied as desired, to produce an equivalent eruption effect. Each individual nozzle has a diameter of about 5/16 of an inch, although this size may be varied as desired, to produce an equivalent eruption effect. In combination, the primary continuous stream water fountains 81 nozzles shown in FIG. 25 have a total diameter of about 18 inches. The plurality of primary continuous stream water fountains 81 may emit about 1000 gallons per minute of water, although this amount may be varied as desired without limitation, including water emitted at a rate of between about 600 and 1400 gallons of water per minute. The plurality of primary continuous stream water fountains 81 may produce a water jet reaching approximately 30 to 40 feet in height, without accounting for the additional height of the water eruption effect support structure 43, although this amount may be varied as desired.

The secondary air-driven water jets 84 are configured similarly as the secondary air-driven water jets 83 discussed in relation to FIG. 8, however, a pool 253 (shown in FIG. 6) is not used to fill the reservoir 103 (shown in FIG. 6). Rather, each secondary air-driven water jet 84 includes a fluid input coupling 811 (shown in FIG. 26) that allows fluid to enter an interior water reservoir of the secondary air-driven water jet 84. The secondary air-driven water jets 84 otherwise operate similarly as the secondary air-driven water jets 83 discussed in relation to FIG. 8. Namely, an air reservoir 107 contains pressured air that releases through a water reservoir of the secondary air-driven water jet 84, which causes water to eject through the nozzle 121 (shown in FIG. 26).

In the embodiment shown in FIG. 25, eight secondary air-driven water jets 84 are positioned on the upper end of the water eruption effect support structure 43, upon the lower housing 805, although this number may be varied as desired. Each secondary air-driven water jet 84 may output about 5 gallons of water, to produce about 40 gallons of emitted water at once. However, in one embodiment, the volume of the secondary air-driven water jet 84 may be increased to about 15 gallons, to produce about 120 gallons emitted into the air at once. The number of secondary air-driven water jets 84, and the volume of water output may be varied to produce the desired eruption effect. As discussed in relation to the secondary air-driven water jet 83 shown in FIG. 8, each secondary air-driven water jet 84 may emit water up to a height of about 50 feet, not including the height of the water eruption effect support structure 43.

Figure 26:
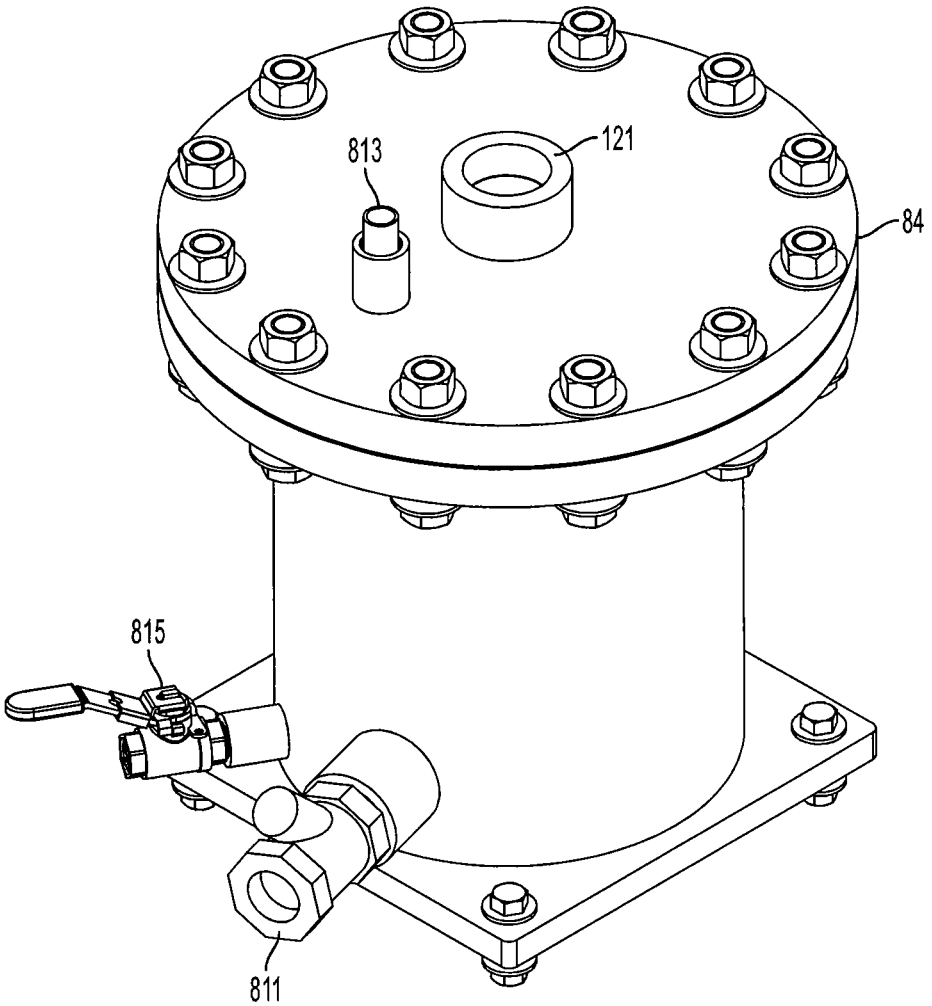
FIG. 26 is a perspective view of a secondary air-driven water jet according to one embodiment of the present invention.

FIG. 26 illustrates a perspective view of one of the secondary air-driven water jets 84 shown in FIGS. 24 and 25. The secondary air-driven water jet 84 includes an output nozzle 121 configured to output water from an internal water reservoir. Water is input into the secondary air-driven water jet 84 through a fluid input conduit 811. In addition, air is input into the secondary air-driven water jet 84 through an air input coupling 813. A release valve 815 allows water to evacuate the interior water reservoir of the secondary air-driven water jet 84. The output nozzle 121 shown in FIG. 26 has a diameter of approximately 2 inches, although this size may be varied to produce a desired effect.

Figure 27:
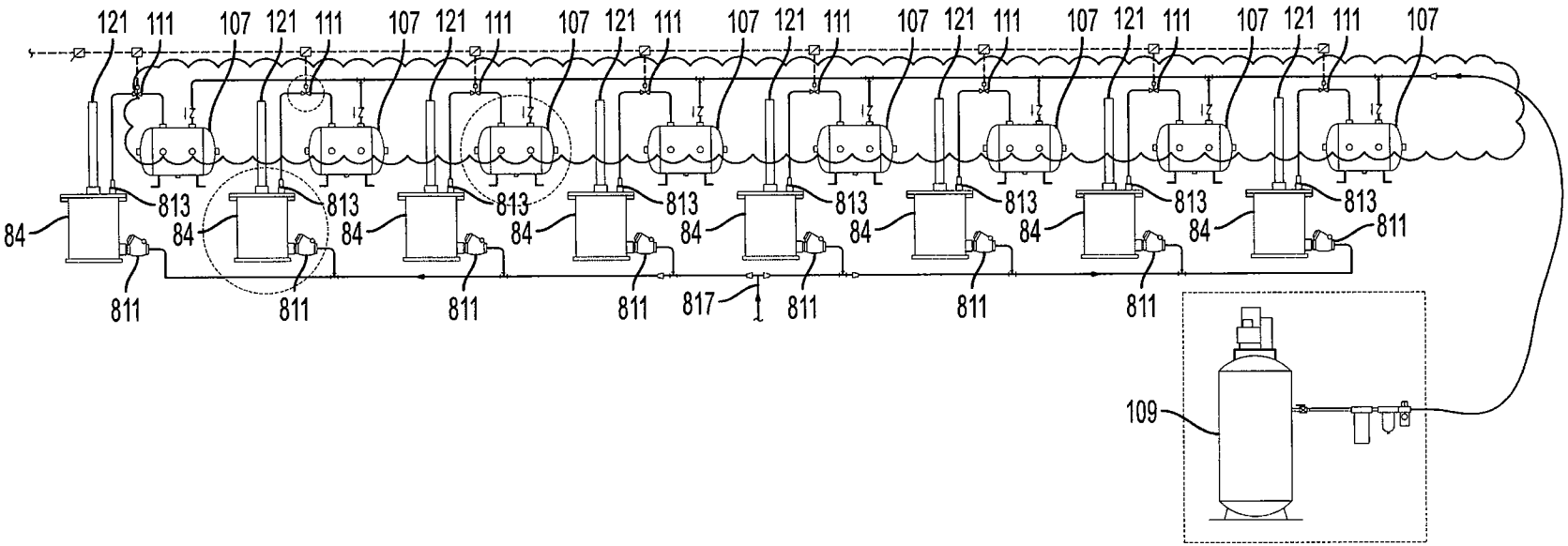
FIG. 27 is a schematic of the water and air connections for secondary air-driven water jets according to one embodiment of the present invention.

FIG. 27 illustrates a schematic view of the water and air connections made to each secondary air-driven water jet 84. First referring to the water connections, a fluid conduit 817 connects to each fluid input conduit 811 of the respective secondary air-driven water jet 84, to fill the respective water reservoirs. The fluid conduit 817 may draw water from the drain system of the water play structure shown in FIG. 2, or from a separate source. The fluid input conduit 811 may extend up the length of the water eruption effect support structure 43 to deliver fluid to the secondary air-driven water jet 84. Referring now to the air connection system, FIG. 27 illustrates an air compression system 109 that compresses air, and may also filter, dry and regulate the air to be used for each secondary air-driven water jet 84. The air compression system 109 fills the air tanks 107 that store pressurized air. The air compression system 109, as used in the embodiment shown in FIGS. 24-25 is preferably located remotely from the secondary air-driven water jets 84. However, in one embodiment the air compression system 109 may be positioned directly on the eruption effect support structure 43. Each air tank 107 is configured to connect to a respective secondary air-driven water jet 84 via a valve 111, which each operate similarly as the valve 111 shown in FIG. 8. Namely, a control system 123, as shown in FIG. 8, operates the valve 111 to release the pressurized air through the internal water reservoir of the secondary air-driven water jet 84 at a desired time. The pressurized air causes the water to eject through the nozzle 121, resulting in an air-driven burst of water.

Figure 28A:
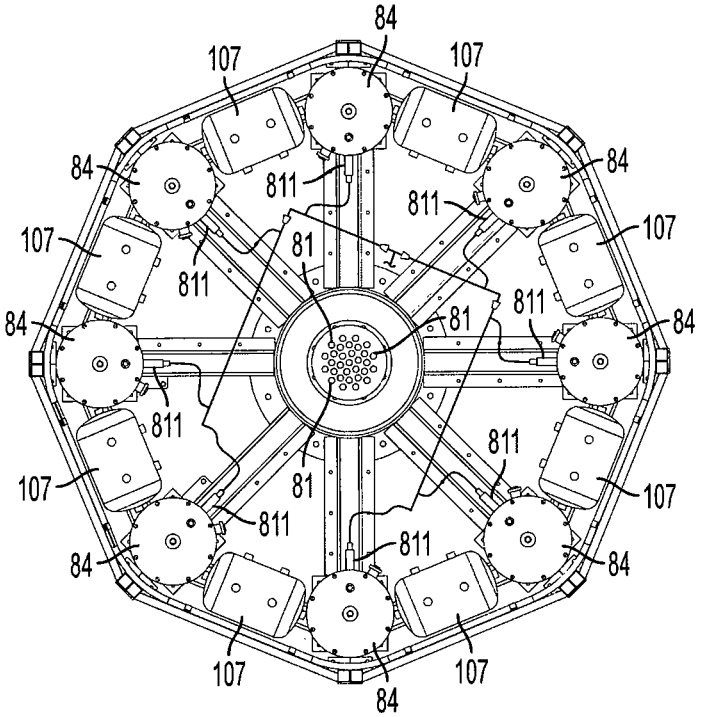
FIG. 28A is a plan view of the water connections for secondary air-driven water jets according to the embodiment of the present invention shown in FIGS. 24 and 25.
Figure 28B:
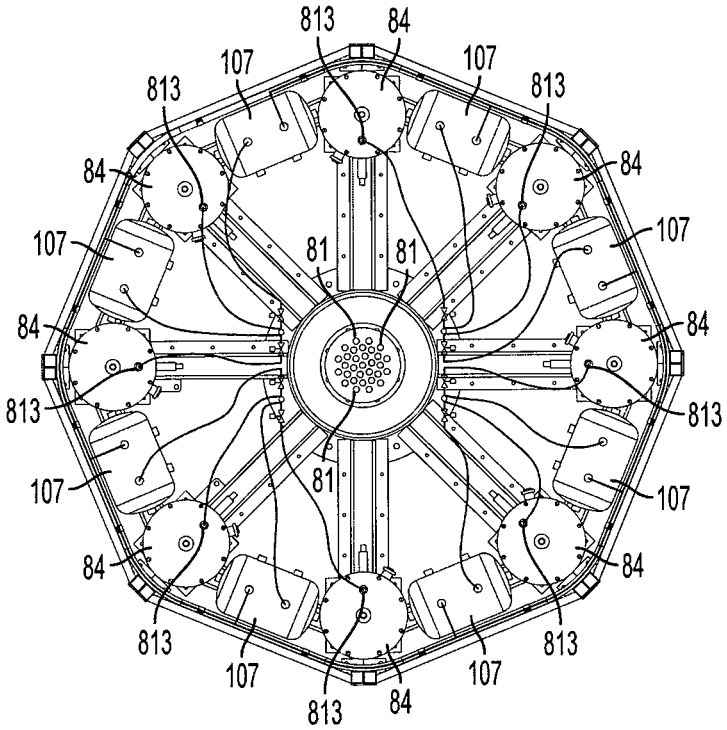
FIG. 28B is a plan view of the air connections for secondary air-driven water jets according to the embodiment of the present invention shown in FIGS. 24 and 25.

FIG. 28A illustrates a top schematic view of the water eruption device 41 shown in FIG. 25. FIG. 28A illustrates the water connection system discussed in relation to FIG. 27, including the water connections of the fluid input conduits 811. FIG. 28B illustrates a top schematic view of the water eruption device 41 shown in FIG. 25. FIG. 28B illustrates the air connection system discussed in relation to FIG. 27, including the air connections between the air tanks 107 and the air input couplings 813.

The primary continuous stream water fountains 81 and the secondary air-driven water jets 84 shown in FIGS. 24-28B may be utilized with any structural, design, or water eruption effect, feature discussed in this application in relation to the water eruption jet 73, including the primary continuous stream water fountains 81 and the secondary air-driven water jets 84 discussed in relation to FIGS. 5-8. For example, the primary continuous stream water fountains 81 and the secondary air-driven water jets 84 shown in FIGS. 24-28B may incorporate any of the light features discussed in relation to FIGS. 7 and 8. In addition, the primary continuous stream water fountains 81 and the secondary air-driven water jets 84 shown in FIGS. 24-28B may be utilized and controlled in response to a RFID reader system 221 or a motion sensor system 235 as discussed in relation to FIGS. 21-23. In addition, the primary continuous stream water fountains 81 and the secondary air-driven water jets 84 shown in FIGS. 24-28B may produce an eruption effect in the same manner as discussed in relation to FIGS. 9A-9D.

In one embodiment, the primary continuous stream water fountains 81 and the secondary air-driven water jets 84 shown in FIGS. 24-28B, and the primary continuous stream water fountains 81 and the secondary air-driven water jets 83 shown in FIGS. 5-8, may erupt in a sequence in which the primary continuous stream water fountains 81 produce the main eruption effect. For example, the eruption sequence may begin with a relatively small flow of water emitted by the primary continuous stream water fountains 81. The primary continuous stream water fountains 81 in this state may continually emit only between 1 foot to 10 feet of water, not accounting for the height of the water eruption effect support structure 43. Then, the secondary air-driven water jets 83, 84 may erupt by emitting water simultaneously, reaching heights of up to 50 feet, not accounting for the height of the water eruption effect support structure 43. Then, either during or after the water is emitted by the secondary air-driven water jets 83, 84, the rate of fluid flow of the primary continuous stream water fountains 81 may increase to a height of between about 30 to 40 feet, not accounting for the height of the water eruption effect support 43. The flow rate of the primary continuous stream water fountains 81 may be sufficient (on the order of about 600 to about 1400 gallons per minute) to reproduce a geyser effect. The height of the fluid emitted by the primary continuous stream water fountains 81 may fluctuate during the geyser effect.

The terms "a," "an," "the" and similar referents used in the context of describing the invention (especially in the context of the following claims) are to be construed to cover both the singular and the plural, unless otherwise indicated herein or clearly contradicted by context. Recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member may be referred to and claimed individually or in any combination with other members of the group or other elements found herein. It is anticipated that one or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

Certain embodiments of this invention are described herein, including the best mode known to the inventors for carrying out the invention. Of course, variations on these described embodiments will become apparent to those of ordinary skill in the art upon reading the foregoing description. The inventor expects skilled artisans to employ such variations as appropriate, and the inventors intend for the invention to be practiced otherwise than specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

Specific embodiments disclosed herein may be further limited in the claims using consisting of or and consisting essentially of language. When used in the claims, whether as filed or added per amendment, the transition term "consisting of" excludes any element, step, or ingredient not specified in the claims. The transition term "consisting essentially of" limits the scope of a claim to the specified materials or steps and those that do not materially affect the basic and novel characteristic(s). Embodiments of the invention so claimed are inherently or expressly described and enabled herein.

In closing, it is to be understood that the embodiments of the invention disclosed herein are illustrative of the principles of the present invention. Other modifications that may be employed are within the scope of the invention. Thus, by way of example, but not of limitation, alternative configurations of the present invention may be utilized in accordance with the teachings herein. Accordingly, the present invention is not limited to that precisely as shown and described.

What is claimed is:

1. A water eruption effect device to entertain and cool individuals, comprising:

a support structure having a substantially columnar shape with a lower end configured to rest on a lower surface and an upper end extending upward from the lower surface;

at least one continuous-stream water fountain coupled to the upper end of the support structure and configured to emit water such that the water emitted by the at least one continuous-stream water fountain falls down towards the lower surface; and at least one air-driven water jet coupled to the upper end of the support structure and configured to emit water driven by air such that the water emitted by the at least one air-driven water jet falls down towards the lower surface.

2. The water eruption effect device of claim 1, wherein the at least one air-driven water jet is a plurality of air-driven water jets positioned circumferentially around the at least one continuous-stream water fountain.

3. The water eruption effect device of claim 1, wherein the at least one continuous-stream water fountain is configured to emit water in a substantially vertical direction, and the at least one air-driven water jet is configured to emit water in a substantially vertical direction.

4. The water eruption effect device of claim 1, wherein a top of the support structure extends from the lower surface at a height of more than about ten feet.

5. The water eruption effect device of claim 1, wherein the support structure is a tower.

6. The water eruption effect device of claim 1, wherein the at least one continuous-stream water fountain is positioned at a greater height from the lower surface than the at least one air-driven water jet.

7. The water eruption effect device of claim 1, wherein the at least one continuous-stream water fountain includes a nozzle configured to allow water pressured by a pump to flow through the nozzle, and the at least one air-driven water jet includes a reservoir configured to fill with water and a valve configured to control a flow rate of pressurized air through the reservoir.

8. The water eruption effect device of claim 1, wherein the at least one continuous-stream water fountain is configured to emit water at a rate of more than about 600 gallons per minute, and the at least one air-driven water jet is configured to emit more than about 40 gallons of water driven by air at once.

9. The water eruption effect device of claim 1, wherein the support structure is positioned within a water play structure, and a fluid conduit extends to the upper end of the support structure to supply water to the at least one continuous-stream water fountain and the at least one air-driven water jet that is collected from a drain of the water play structure.

10. A water play system for entertaining and cooling play participants comprising:

a water play structure positioned on a lower surface;

a conduit system configured to transport water from a water source to water play elements coupled to the water play structure;

a water eruption effect support structure elevated above the lower surface;

at least one continuous-stream water fountain coupled to the water eruption effect support structure and configured to emit water such that the water emitted by the at least one continuous-stream water fountain falls down towards the lower surface; and at least one air-driven water jet coupled to the water eruption effect support structure and configured to emit water driven by air such that the water emitted by the at least one air-driven water jet fails down towards the lower surface.

11. The water play system of claim 10, wherein a fluid conduit extends to the water eruption effect support structure to supply water to the at least one continuous-stream water fountain and the at least one air-driven water jet that is collected from a drain of the water play structure.

12. The water play system of claim 10, further comprising an electrical control system configured to operate the at least one air-driven water jet based on whether a radio frequency identification signal is detected by a radio frequency identification sensor, or a whether motion is detected by a motion control sensor.

13. The water play system of claim 10, wherein the water eruption effect support structure has a substantially columnar shape with a lower end configured to rest on the lower surface and an upper end extending upward from the lower surface, and the at least one continuous-stream water fountain and the at least one air-driven water jet are coupled to the upper end.

14. The water play system of claim 10, wherein the at least one continuous-stream water fountain is configured to emit water at a rate of more than about 600 gallons per minute, and the at least one air-driven water jet is configured to emit more than about 40 gallons of water driven by air at once.

15. The water play system of claim 10, wherein the at least one continuous-stream water fountain includes a nozzle configured to allow water pressured by a pump to flow through the nozzle, and the at least one air-driven water jet includes a reservoir configured to fill with water and a valve configured to control a flow rate of pressurized air through the reservoir.

16. A method for producing a water eruption effect to entertain and cool individuals comprising:

providing a support structure having a substantially columnar shape with a lower end resting on a lower surface and an upper end extending upward from the lower surface;

operating at least one continuous-stream water fountain coupled to the upper end of the support structure and configured to emit water such that the water emitted by the at least one continuous-stream water fountain falls down towards the lower surface; and operating at least one air-driven water jet coupled to the upper end of the support structure and configured to emit water driven by air such that the water emitted by the at least one air-driven water jet falls down towards the lower surface.

17. The method of claim 16, further comprising a step of signaling, using a sound speaker or a lighting device, that the operation of the at least one air-driven water jet will occur at least within a span of a minute.

18. The method of claim 16, wherein the at least one continuous-stream water fountain is configured to emit water at a rate of more than about 600 gallons per minute, and the at least one air-driven water jet is configured to emit more than about 40 gallons of water driven by air at once.

19. The method of claim 16, wherein the at least one continuous-stream water fountain includes a nozzle configured to allow water pressured by a pump to flow through the nozzle, and the at least one air-driven water jet includes a reservoir configured to fill with water and a valve configured to control a flow rate of pressurized air through the reservoir.

20. The method of claim 16 further comprising the step of signaling that the operation of the at least one air-driven water jet will occur within a predetermined amount of time.

* * * * *